US009022621B2

(12) United States Patent
Boyer et al.

(10) Patent No.: US 9,022,621 B2
(45) Date of Patent: May 5, 2015

(54) LUMINAIRES AND LUMINAIRE MOUNTING STRUCTURES

(71) Applicant: LSI Industries, Inc., Cincinnati, OH (US)

(72) Inventors: John D. Boyer, Lebanon, OH (US); Daniel Hutchens, Cold Spring, KY (US); Eric Jon Mooar, Liberty Township, OH (US)

(73) Assignee: LSI Industries, Inc., Cincinnati, OH (US)

( * ) Notice: Subject to any disclaimer, the term of this patent is extended or adjusted under 35 U.S.C. 154(b) by 57 days.

(21) Appl. No.: 14/071,885

(22) Filed: Nov. 5, 2013

(65) Prior Publication Data

US 2014/0268820 A1 Sep. 18, 2014

Related U.S. Application Data

(63) Continuation of application No. 13/828,446, filed on Mar. 14, 2013.

(51) Int. Cl.
*F21V 31/00* (2006.01)
*F21V 15/01* (2006.01)
(Continued)

(52) U.S. Cl.
CPC ..... *F21V 21/14* (2013.01); *F21V 21/00* (2013.01); *F21V 5/04* (2013.01); *F21K 9/00* (2013.01);
(Continued)

(58) Field of Classification Search
CPC ..... F21Y 2105/001; F21Y 2105/00; F21V 31/00; F21V 31/005; F21V 31/03; F21V 31/04; F21V 17/101; F21V 17/107; F21V 17/12; F21V 17/18; F21V 19/00; F21V 19/0035; F21V 19/005; F21V 21/02; F21V 21/03; F21V 21/06; F21V 21/116; F21V 15/01; F21S 8/00; F21S 8/02; F21S 8/026; F21S 8/04; F21S 8/043; F21S 8/06; F21K 9/00
USPC ..... 362/267
See application file for complete search history.

(56) References Cited

U.S. PATENT DOCUMENTS 3,895,227 A * 7/1975 Murray et al. ..... 362/294
5,997,158 A 12/1999 Fischer et al.
(Continued)

FOREIGN PATENT DOCUMENTS

CN 201680304 12/2010
EP 2397745 12/2011
(Continued)

OTHER PUBLICATIONS

Lousy Cables Made by Somebody's Brother In-Law, Design News, 5 pages (2012).
(Continued)

*Primary Examiner* — Alan Cariaso
(74) *Attorney, Agent, or Firm* — McDermott Will & Emery LLP

(57) ABSTRACT

A luminaire having a housing defining one or more unthreaded mounting holes therein, a connector having a head and a shaft, the connector shaft located at least partially in one of the one or more mounting holes, the connector shaft comprised of a pliable material, a circuit board mounted to the housing by the connector head, the circuit board populated with one or more LEDs, and a lens resting against and spaced form the circuit board by the connector head.

20 Claims, 18 Drawing Sheets

(51) Int. Cl.

| | |
|---|---|
| ***F21V 21/14*** | (2006.01) |
| ***F21V 21/00*** | (2006.01) |
| ***F21V 5/04*** | (2006.01) |
| ***F21K 99/00*** | (2010.01) |
| ***F21V 31/03*** | (2006.01) |
| ***F21V 31/04*** | (2006.01) |
| ***F21V 17/10*** | (2006.01) |
| ***F21V 17/12*** | (2006.01) |
| ***F21V 19/00*** | (2006.01) |
| ***F21V 21/02*** | (2006.01) |
| ***F21V 21/03*** | (2006.01) |
| ***F21V 21/06*** | (2006.01) |
| ***F21V 21/116*** | (2006.01) |
| ***F21S 8/00*** | (2006.01) |
| ***F21S 8/02*** | (2006.01) |
| ***F21S 8/04*** | (2006.01) |
| ***F21S 8/06*** | (2006.01) |
| ***F21V 17/18*** | (2006.01) |
| ***F21V 23/00*** | (2006.01) |
| ***F21V 23/02*** | (2006.01) |
| *F21Y 105/00* | (2006.01) |

(52) U.S. Cl.

CPC ..... *F21V 31/005* (2013.01); *F21V 31/03* (2013.01); *F21V 31/04* (2013.01); *F21V 17/101* (2013.01); *F21V 17/12* (2013.01); *F21V 19/00* (2013.01); *F21V 19/0035* (2013.01); *F21V 19/005* (2013.01); *F21V 21/02* (2013.01); *F21V 21/03* (2013.01); *F21V 21/06* (2013.01); *F21V 21/116* (2013.01); *F21Y 2105/00* (2013.01); *F21S 8/00* (2013.01); *F21S 8/02* (2013.01); *F21S 8/04* (2013.01); *F21S 8/06* (2013.01); *F21V 17/107* (2013.01); *F21V 17/18* (2013.01); *F21V 23/001* (2013.01); *F21V 23/007* (2013.01); *F21V 23/02* (2013.01); *F21V 29/507* (2015.01); *F21V 29/83* (2015.01)

(56) References Cited

U.S. PATENT DOCUMENTS

| | | | | |
|---|---|---|---|---|
| 6,059,422 | A | 5/2000 | Fischer et al. | |
| 6,168,300 | B1 | 1/2001 | Fischer et al. | |
| 6,224,233 | B1 | 5/2001 | Fischer et al. | |
| 6,394,628 | B1 * | 5/2002 | Wang | 362/375 |
| 6,422,720 | B2 | 7/2002 | Fischer et al. | |
| 6,497,499 | B1 | 12/2002 | Fischer et al. | |
| 6,843,580 | B2 | 1/2005 | Fischer et al. | |
| 7,604,390 | B2 | 10/2009 | Zhang et al. | |
| 8,033,677 | B1 * | 10/2011 | Olsson et al. | 362/101 |
| 8,083,369 | B1 | 12/2011 | Richardson | |
| 8,177,381 | B2 | 5/2012 | Hong et al. | |
| 8,317,371 | B1 | 11/2012 | Khosrow et al. | |
| 8,648,979 | B2 | 2/2014 | Kuromizu | |
| 2006/0104080 | A1 | 5/2006 | Kim et al. | |
| 2006/0171144 | A1 | 8/2006 | Yuen | |
| 2006/0232974 | A1 * | 10/2006 | Lee et al. | 362/294 |
| 2007/0217196 | A1 | 9/2007 | Shaner | |
| 2008/0106897 | A1 | 5/2008 | Yoon et al. | |
| 2010/0044589 | A1 | 2/2010 | Garcia et al. | |
| 2010/0110701 | A1 | 5/2010 | Liu et al. | |
| 2010/0208473 | A1 * | 8/2010 | Sakai et al. | 362/373 |
| 2011/0044039 | A1 | 2/2011 | Chung et al. | |
| 2011/0241549 | A1 | 10/2011 | Wootton | |
| 2011/0242828 | A1 | 10/2011 | Blincoe | |
| 2011/0317428 | A1 | 12/2011 | Paik et al. | |
| 2011/0317437 | A1 | 12/2011 | Chang | |
| 2012/0033419 | A1 | 2/2012 | Kim et al. | |
| 2012/0230019 | A1 | 9/2012 | Peifer | |
| 2012/0268929 | A1 | 10/2012 | Chung et al. | |
| 2013/0141896 | A1 | 6/2013 | Li et al. | |

FOREIGN PATENT DOCUMENTS

| | | | | |
|---|---|---|---|---|
| GB | 953243 | | 3/1964 | |
| JP | 54121583 | A * | 9/1979 | F21V 21/30 |
| JP | 2007213943 | | 8/2007 | |
| WO | 2011119330 | | 9/2011 | |

OTHER PUBLICATIONS

Examination Report dated Dec. 12, 2013 from Corresponding Australian Patent Application No. 2013202264.

International Search Report and the Written Opinion dated May 28, 2014 from Corresponding PCT Application No. PCT/US2014/018254.

Invitation to Pay Additional Fees and, Where Applicable, Protest Fee dated Jun. 25, 2014 from Corresponding PCT Application No. PCT/US2014/018250.

Response to the Examination Report filed on Nov. 23, 2014 in corresponding Australian Patent Application No. 2013202264.

International Search Report and the Written Opinion dated Nov. 3, 2014 from corresponding PCT Application No. PCT/US2014/018250.

Acrich2 4.5W, Product Introduction Sheet, LED module technology, Seoul Semiconductor Co., Ltd.

Acrich2 8.7W, Product Introduction Sheet, LED module technology, Seoul Semiconductor Co., Ltd.

Acrich2 10W, Product Introduction Sheet, LED module technology, Seoul Semiconductor Co., Ltd.

Acrich2 13W, Product Introduction Sheet, LED module technology, Seoul Semiconductor Co., Ltd.

Acrich2 17W, Product Introduction Sheet. LED module technology. Seoul Semiconductor Co., Ltd.

* cited by examiner

LUMINAIRES AND LUMINAIRE MOUNTING STRUCTURES

This application, and the following patent applications, were all filed on Nov. 5, 2013 as continuation applications of application Ser. No. 13/828,446 filed Mar. 14, 2013 and are all related applications: Ser. Nos. 14/071,878; 14/071,891; 14/071,897; 14/071,908.

FIELD OF THE DISCLOSURE

The present disclosure is directed generally to a luminaire for casting light to a target area to be lighted. More particularly the present disclosure is directed to a luminaire constructed from a minimum number of parts and/or with a minimum profile. The present disclosure further relates to a manner of ventilating the inside of a luminaire. The present disclosure also relates to mounting structures to facilitate simple and quick mounting of a luminaire to a pre-existing housing.

BACKGROUND OF THE DISCLOSURE

There is a need for a luminaire and mounting structure of the type described herein. More particularly, there is a need for a low-profile luminaire capable of providing proper light distribution. There is also a need for a luminaire having a minimum number of parts and capable of providing proper light distribution. Furthermore, there is a particular need for a low-profile luminaire capable of providing proper light distribution and having a minimum number of parts.

SUMMARY OF THE DISCLOSURE

A luminaire comprising a housing defining one or more mounting holes therein, the mounting holes not threaded; a connector having a head and a shaft, the connector shaft located at least partially in one of the one or more mounting holes, the connector shaft comprised of a pliable material; a circuit board mounted to the housing by the connector head, the circuit board populated with one or more LEDs; and a lens resting against and spaced form the circuit board by the connector head. The connector can define a screw with threads on the connector shaft. The pliable material may be nylon. The circuit board can define holes and the connector shaft can extend through the circuit board holes, the connector head holding the circuit board to the housing. At least one of the mounting holes can be defined in a face of the housing, the housing can further comprise a cylindrical spacer boss extending outward from the housing face extending the at least one mounting hole beyond the face, the circuit board can define at least one hole and the cylindrical spacer boss can be located in the circuit board hole. The housing can comprise a substantially flat plate and the one or more mounting holes can be located in the plate; the plate can define a face; a cylindrical spacer boss can extend outward from the housing face to extend the at least one mounting hole beyond the face, the circuit board can define at least one hole and the cylindrical spacer boss can be located in the circuit board hole. The circuit board can be mounted directly against the housing.

A luminaire comprising a housing; a lens frame comprising a perimeter, an outer trough wall, an inner trough wall and a base extending between the outer trough wall and the inner trough wall, the inner trough wall, base and outer trough wall defining a trough; the outer trough wall being taller than the inner trough wall; an adhesive sealant in the trough; and a lens resting on a distal end of the inner trough wall and contacting the adhesive sealant. The trough can extend around the entire perimeter of the lens. The trough can extend around an inner perimeter of the lens frame. The adhesive sealant can be a urethane. An adhesive sealant can be provided around an outer perimeter of the outer trough wall forming a seal between the housing and lens frame. The outer trough wall can extend higher than the lens.

A luminaire comprising a plurality of LEDs arranged in a matrix at a pitch P; the luminaire is configured to drive each LED to produce L lumens per LED; and a ratio of L to P being between approximately 59.2 lumens/inch and 70.4 lumens/inch; wherein the LEDs provide a combined even glow when illuminated. P can be approximately 0.625 inches. The ratio of L to P can be approximately 59.2 lumens/inch at 530 mA and 70.4 lumens/inch at 650 mA. One of more of the plurality of LEDs can be a 0.25 Watt LED.

A luminaire comprising a housing defining a front side and a rear side; a circuit board mounted to the housing front side; a column extending from the housing rear side to an end, an aperture defined in the column end; and a breathing tube extending through the column aperture. A box can be mounted to the end of the column and the breathing tube can extend into the box. The box can be a driver box housing a driver to power the LEDs. The luminaire can be sealed against ingress or egress of water or air, except for through the breathing tube. The breathing tube can be sealed in the column aperture with a sealant and the breathing tube can be run through the sealant, the sealant preventing ingress of air or water into the housing except through the breathing tube. A sealant filled gland can be secured to the column aperture, the gland filled with a sealant, the breathing tube running through the sealant, the sealant preventing ingress of air or water into the housing except through the breathing tube.

A luminaire comprising a housing defining a front side and a rear side; a circuit board mounted to the housing front side; a column extending from the housing rear side to an end; a box mounted to the end of the column and having a stem extending downward to a lower distal end and accommodating the column within the stem; and the stem defining a groove in the lower distal end for receiving a gasket to create a seal when mounted against a structure when the luminaire is installed in the structure. The box can be a driver box housing a driver to power the circuit board. The structure can be a canopy. The box can be integral with the stem. The box can be mounted to the column.

A mounting apparatus for mounting a luminaire to a mounting structure comprising a face plate defining an aperture, the mounting apparatus comprising: a mounting plate for mounting to the luminaire; the mounting plate having an extension flange; a pair of wings extending from opposing sides of the extension flange for residing within the aperture; and the wings for extending beyond the aperture over the face plate. A driver flange can extend from the mounting plate and a driver mounted to the driver flange for providing power to the luminaire. The mounting apparatus can further comprising a flange for extending upward from the luminaire toward the face plate; a screw having a threaded shaft for extending through the luminaire; and a lock wing mounted on the threaded shaft, the lock wing comprising a lock arm extending a first distance to a distal end and a stop arm extending a second distance to a distal end; the first distance being longer than the second distance; wherein, the lock wing is rotatable by rotation of the screw to rotate the lock arm between a position over the face plate aperture and a position over the face plate. The lock arm and stop arm can be integrally connect by a bridge member. When the lock arm is rotated from over the face plate aperture to over the face plate when rotating the lock wing in a first direction, the stop arm can contact the flange to prevent the lock wing from continuing rotation in the first direction before the lock arm is rotated back over the face plate aperture.

BRIEF DESCRIPTION OF THE DRAWINGS

Aspects and embodiments of the present disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings.

Figure 1A:
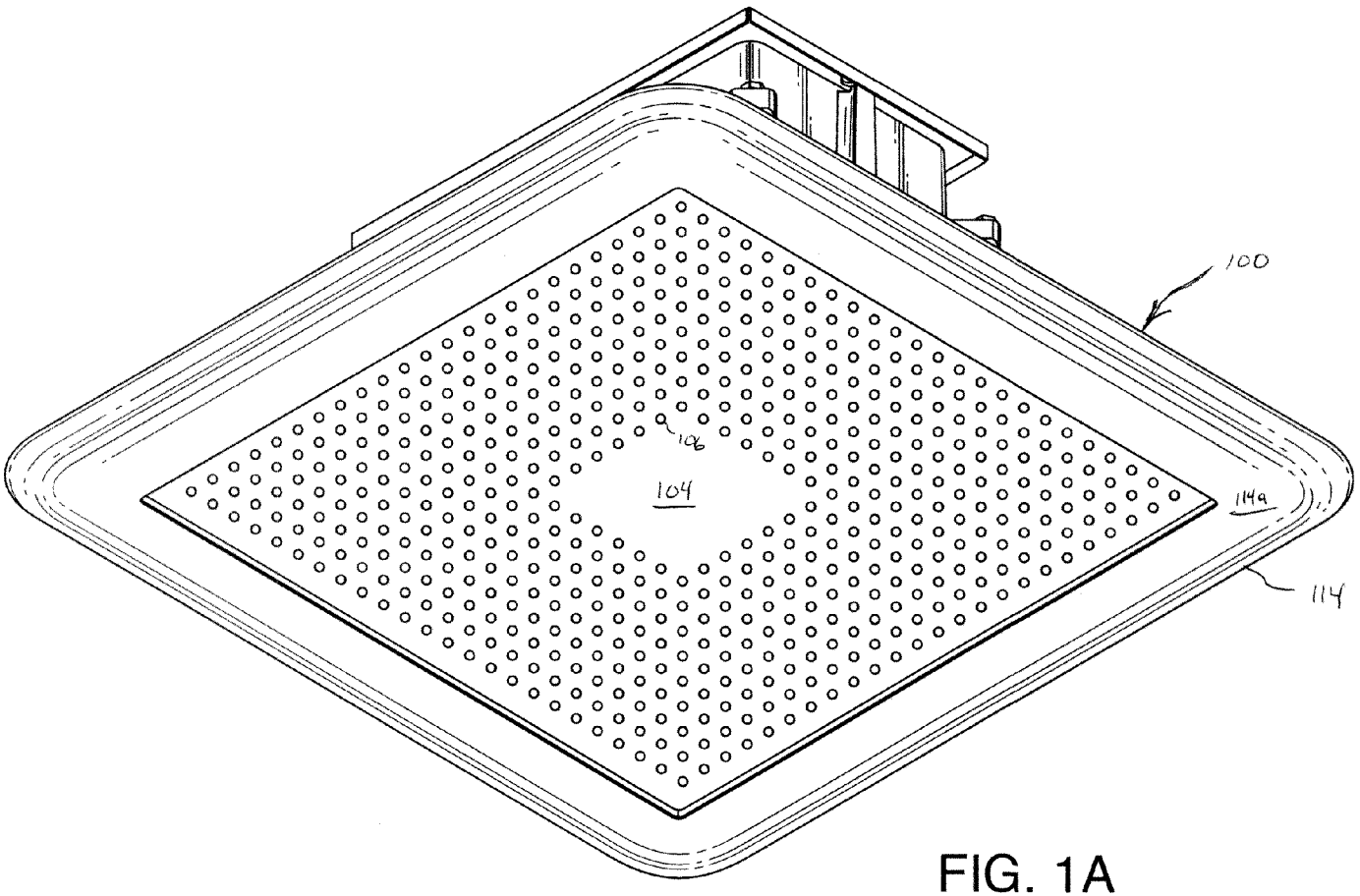
FIG. 1A is a bottom-side perspective view of a luminaire in accordance with the present disclosure.

The embodiments depicted in the drawing are merely illustrative. Variations of the embodiments shown in the drawings, including embodiments described herein, but not depicted in the drawings, may be envisioned and practiced within the scope of the present disclosure.

DETAILED DESCRIPTION

Aspects and embodiments of the present disclosure provide luminaires and elements thereof. Luminaires according to the present disclosure can be used for new installations or to replace existing luminaires or elements thereof. Use of such luminaire and lighting elements can afford reduced energy and maintenance as well as reduced installation time and costs when compared to existing techniques. The versatility of the luminaire and elements of the present disclosure also afford efficiencies to manufacturers, installers and end-users of such luminaire through lower manufacturing and inventory costs as well as the ability of the end-user to upgrade, adapt or fix the luminaire in the field.

While the preferred embodiment uses light emitting diodes ("LEDs") as light sources, other light sources may be used in addition to LEDs or instead of LEDs within the scope of the present disclosure. By way of example only, other light sources such as plasma light sources may be used. Further, the term "LEDs" is intended to refer to all types of light emitting diodes including organic light emitting diodes or "OLEDs".

While the luminaire depicted in the Figures is generally applicable to any application that would benefit from indoor or outdoor area lighting, it is well-suited, in one example, for application to canopies and the like such as those used at petroleum refill stations. In other applications, luminaires and mounting structures disclosed herein are applicable to soffits or ceilings.

Figure 1B:
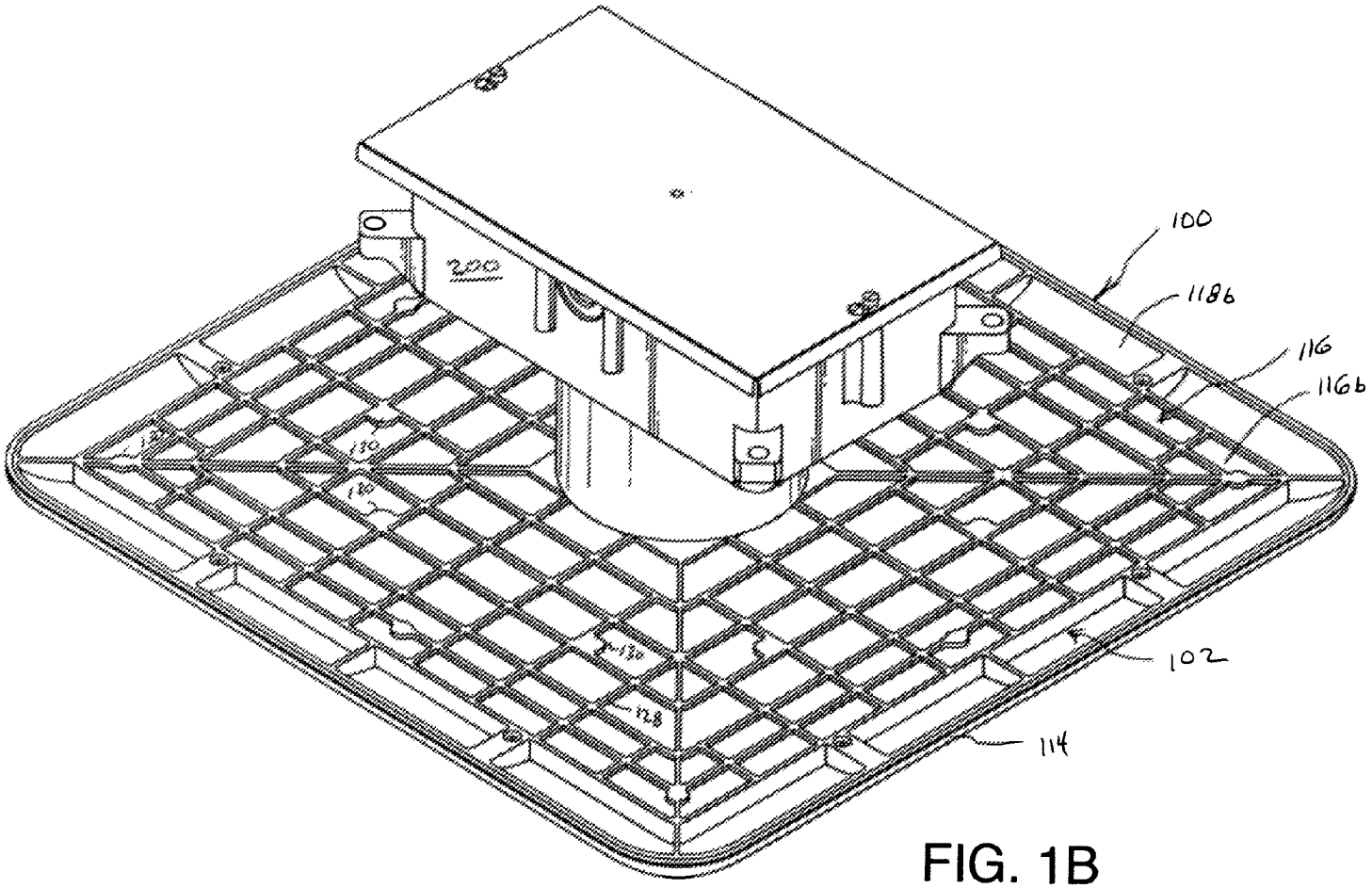
FIG. 1B is a top-side perspective view of the luminaire depicted in FIG. 1A with driver box and stem.
Figure 1C:
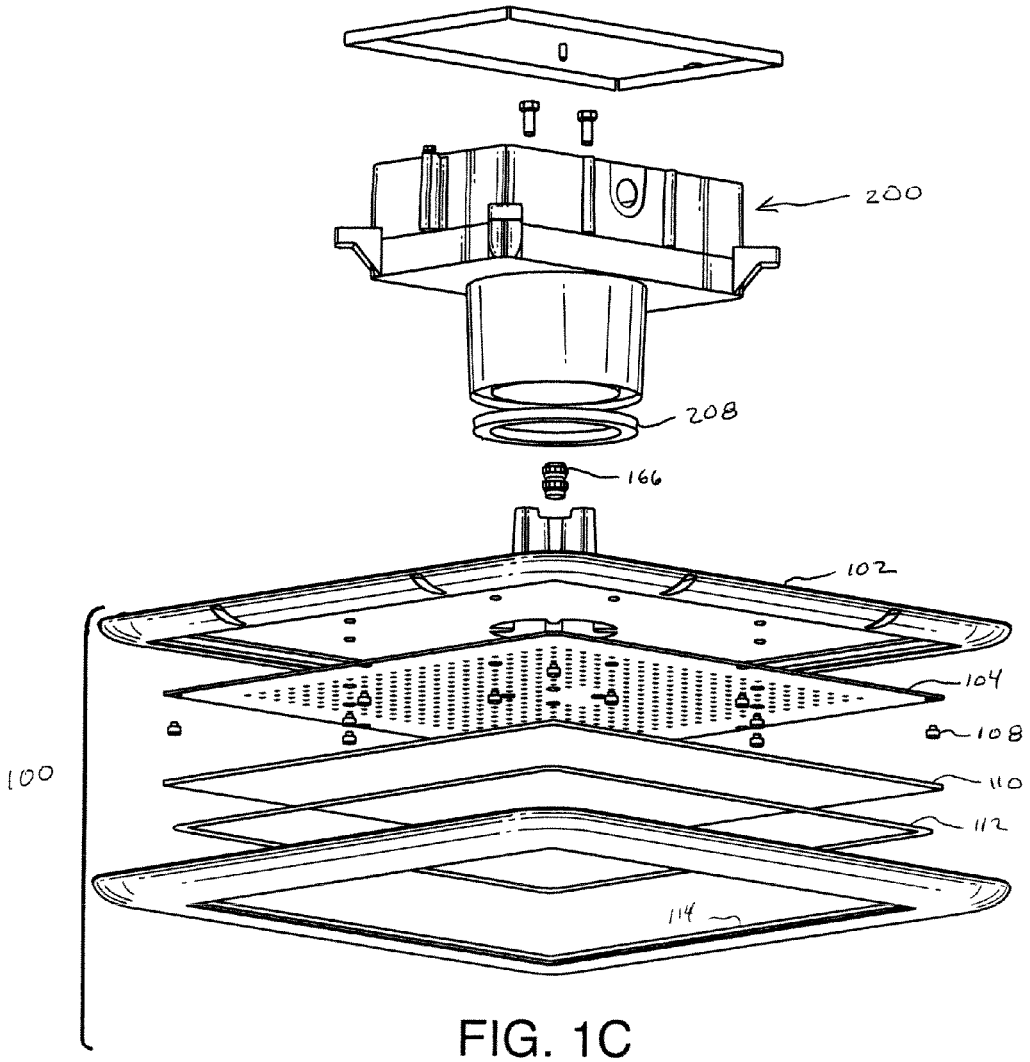
FIG. 1C is an exploded view of the luminaire depicted in FIG. 1A with driver box, stem and gasket.

FIGS. 1A and 1B depict bottom-side and top-side perspective views of a luminaire 100, in accordance with the present disclosure, which is a low-profile luminaire capable of providing proper light distribution and having a minimum number of parts. The luminaire 100 comprises a housing 102, a circuit board 104 populated with light sources 106 such as LEDs, a plurality of screws 108, a lens 110, a gasket 112 and a lens frame 114. The circuit board 104 can be any known circuit board for properly arranging the light sources 106 and, in one embodiment, can be a printed circuit board ("PCB"). For the sake of simplicity, circuit board 104 will be referred to herein as a PCB, but it will be understood that any type of circuit board is suffice.

The overall shape of the luminaire 100 is depicted as substantially square with rounded corners, but other shapes are contemplated as operating within the scope of this disclosure. By way of example only, rectangular, circular and triangular are all contemplated. Because the overall shape of the luminaire 100 is dictated in the depicted embodiment by the shape of the housing 102 and the lens frame 114, the shape of the housing 102 and lens frame 114 are likewise contemplated as have these exemplary shapes or others.

The housing 102 comprises a plate 116, a perimeter 118 and a wall 120 between the face 116 and the perimeter 118. The perimeter 118 extends about the perimeter of the housing and thus takes the shape of the housing, which in the depicted embodiment, is square with rounded corners, as discussed above. The perimeter 118 defines a front face 118*a* and a rear face 118*b*. The front face 118*a* of the perimeter 118 extends from an inner edge 118*c* to an outer edge 118*d* which defines the outermost perimeter of the housing 102. The perimeter inner edge 118*c* defines the downward most facing portion of the housing 102. The front face 118*a* of the perimeter 118 extends from the perimeter inner edge 118*c* to the perimeter outer edge 118*d* forming a curvilinear front face 118*a*. In the depicted embodiment, the curvilinear front face 118*a* initially extends outward form the inner edge 118*c* in straight horizontal manner, and then curves upward with an ever-increasing radius of curvature to the perimeter outer edge 118*d*. Other curvilinear shapes are contemplated as falling within this disclosure. By way of example only, the front face could extend horizontally to a 90° edge, which then extends upward to the outer edge.

References herein to upward and downward orientation are with reference to the depicted embodiments in which the luminaire 100 is mounted to the underside of a flat structure (such as a ceiling or a canopy) and are for purposes of conveying a description of the elements of the disclosure, but are in no way intended to be limiting. In application, upward can be reoriented downward and downward can be reoriented upward.

Figure 4A:
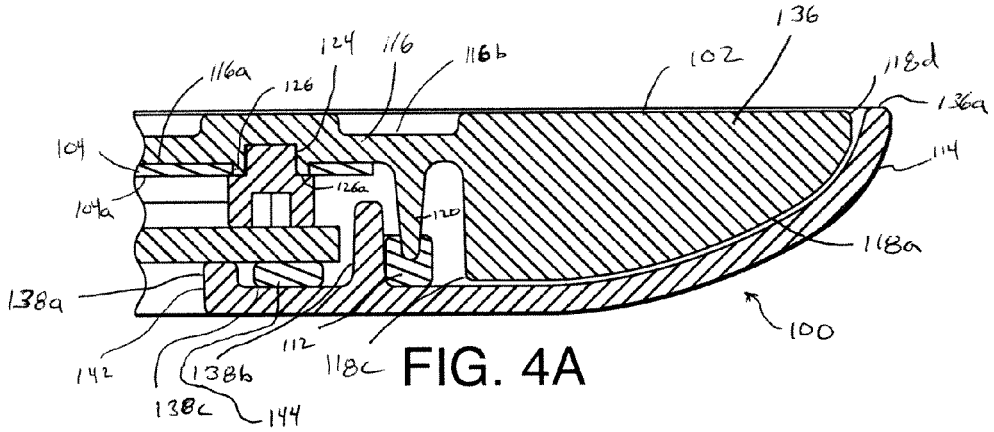
FIG. 4A is a cross-section of a portion of the luminaire depicted in FIG. 1A.
Figure 4B:
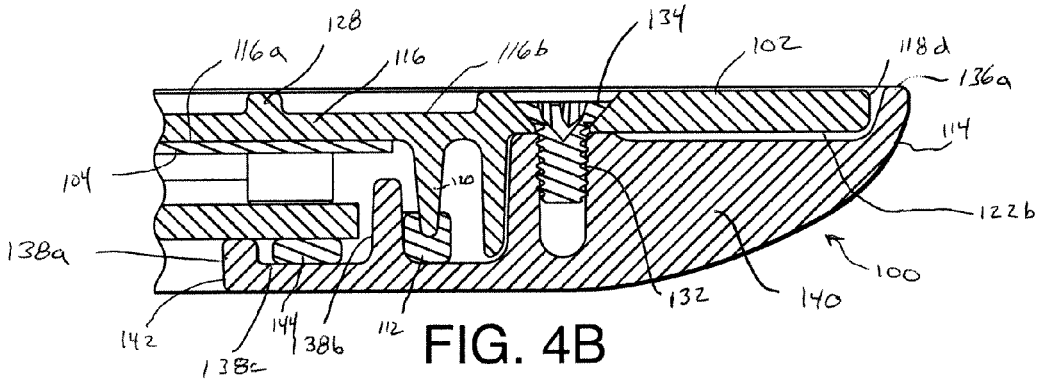
FIG. 4B is a different cross-section of a portion of the luminaire depicted in FIG. 1A.

The housing perimeter 118 preferably defines one or more locator grooves 122 extending from the perimeter front face upward into the perimeter with a locator groove wall 122*a* to a locator groove base 122*b* that is flat in the depicted embodiments, but can vary, extending horizontally. The locators grooves 122 receive locator bosses 140 on the lens frame 114 to assist in properly locating the lens frame 114 on the housing 102 and, separately, to accommodate a boss from the lens frame 114 which can receive a mounting screw 134 from the groove base 122*b*, which will remain hidden from sight to persons viewing the bottom of the luminaire 100, in the depicted embodiment. FIG. 4B depicts a cross-section of a portion of the luminaire 100 through a locator groove 122, a corresponding locator boss 140 and mounting screw 134.

In the depicted embodiment, the luminaire 100 defines two locator grooves 122 on each of the four sides defining the square shape of the luminaire 100. Greater or fewer locator grooves 122 are contemplated. For example, if the locator grooves 122 are used purely for locating the lens frame 114 on the housing 102, then one, or two would suffice. Alternatively, an embodiment of the luminaire 100 is contemplated with no locator grooves 122. If, however, the locator grooves 122 are used to accommodate a boss to facilitate mounting the housing 102 to the lens frame 114 by screw, or the like, then the number and location of the locator grooves 112 will be dictated by the size and weight of the lens frame 114 in order to properly secure the lens frame 114 to the housing 102 with sufficient sealing there between, if desired, as discussed below.

Figure 2A:
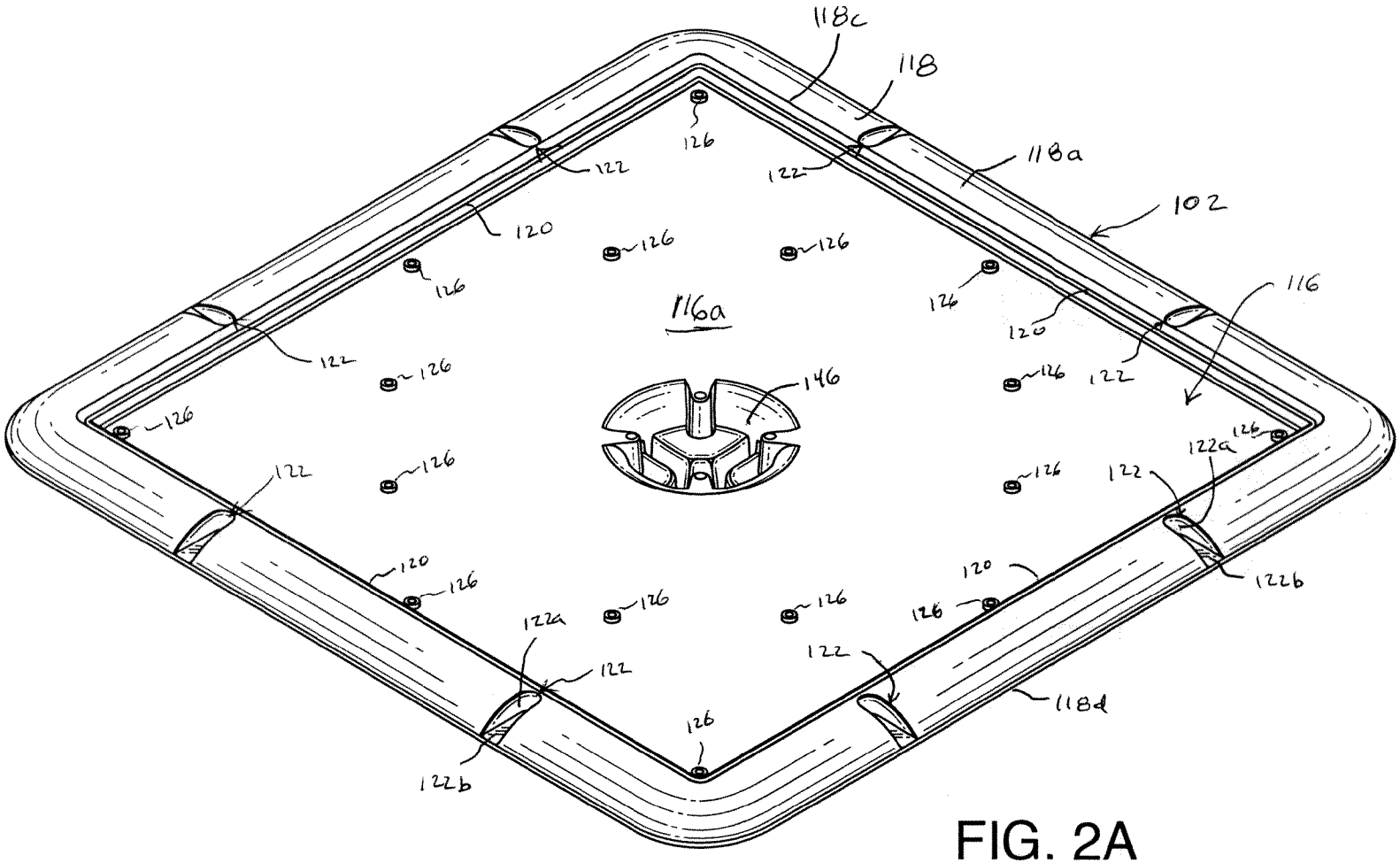
FIG. 2A is a bottom-side perspective view of a housing of the luminaire depicted in FIG. 1A.
Figure 2B:
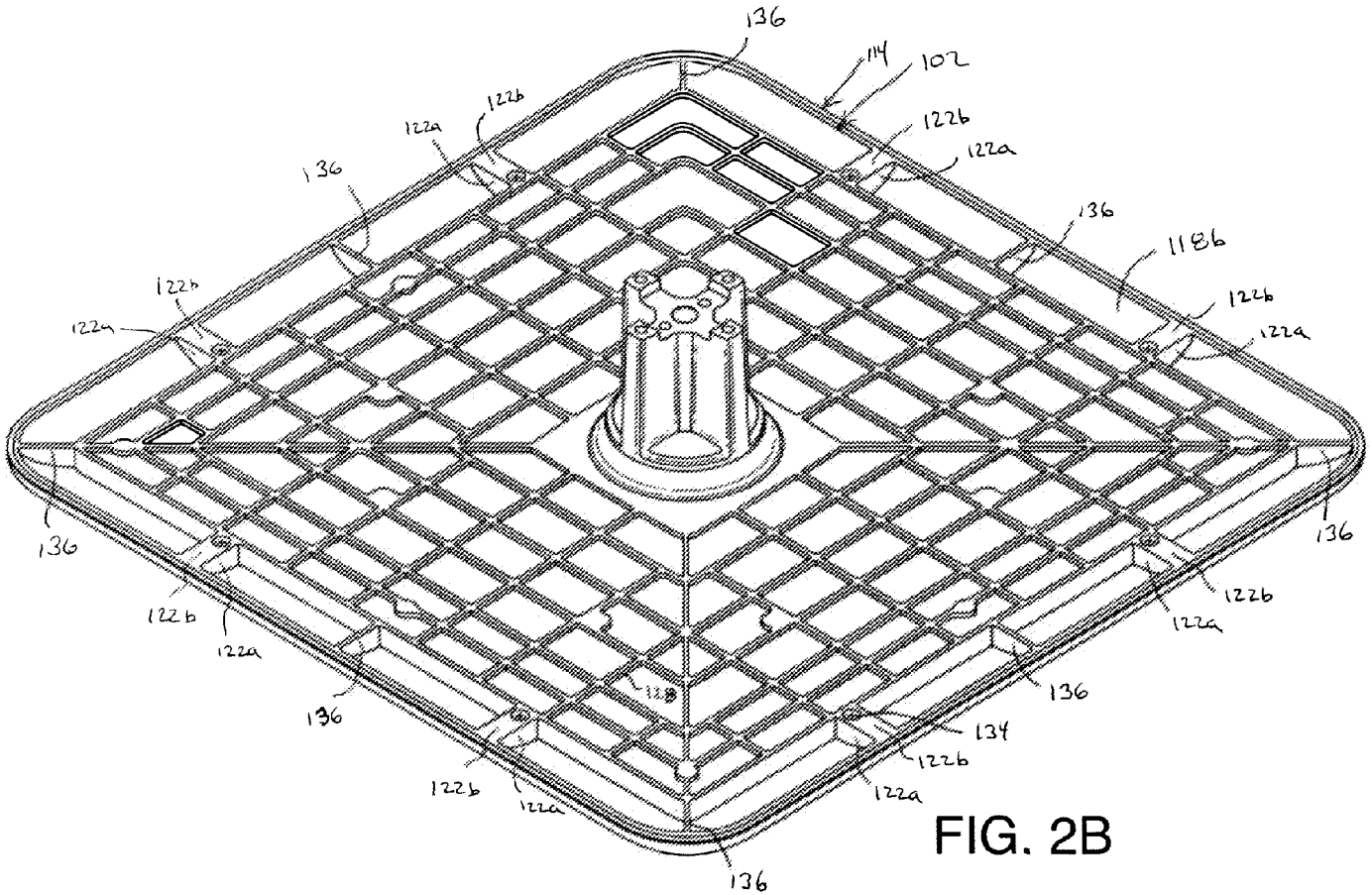
FIG. 2B is a top-side perspective view of a housing of the luminaire depicted in FIG. 1A with the lens frame shown for context.

The housing plate 116 extends across the housing to fill in the area surrounded by the housing perimeter 118. The housing wall 120 extends downward from the housing plate 116 just inward of the housing perimeter 118 to a distal end 120*a* and about the entire housing plate 116 as depicted in FIG. 2A. The housing wall 120 does not extend as far down as the inner edge of the perimeter 118. Rather, the housing wall 120 extends downward far enough to engage the gasket 112 located in the lens frame 114 as shown in FIGS. 4A-4D and discussed below. In this manner, the wall 120 deforms the gasket 112 forming a vapor and moisture barrier there between. Because the wall 120 and gasket 112 extend about the entire luminaire 100 just inward of the perimeter 118, a vapor and moisture barrier is formed between areas inward of the wall 120 (e.g. the PCB) and areas outward of the wall 120. This construction forms a barrier against vapor and moisture that might otherwise ingress between the housing 102 and lens frame 114. The housing wall 120 can take different forms as seen in FIGS. 4A-4D in order to minimize weight and material while still creating sufficient deformation of the gasket 112 to create desired vapor and moisture barrier.

Figure 4C:
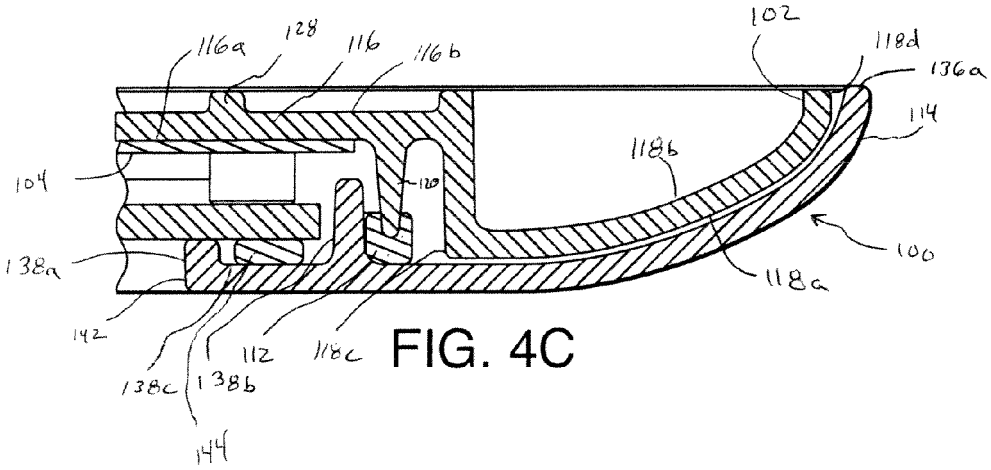
FIG. 4C is yet another different cross-section of a portion of the luminaire depicted in FIG. 1A.
Figure 4D:
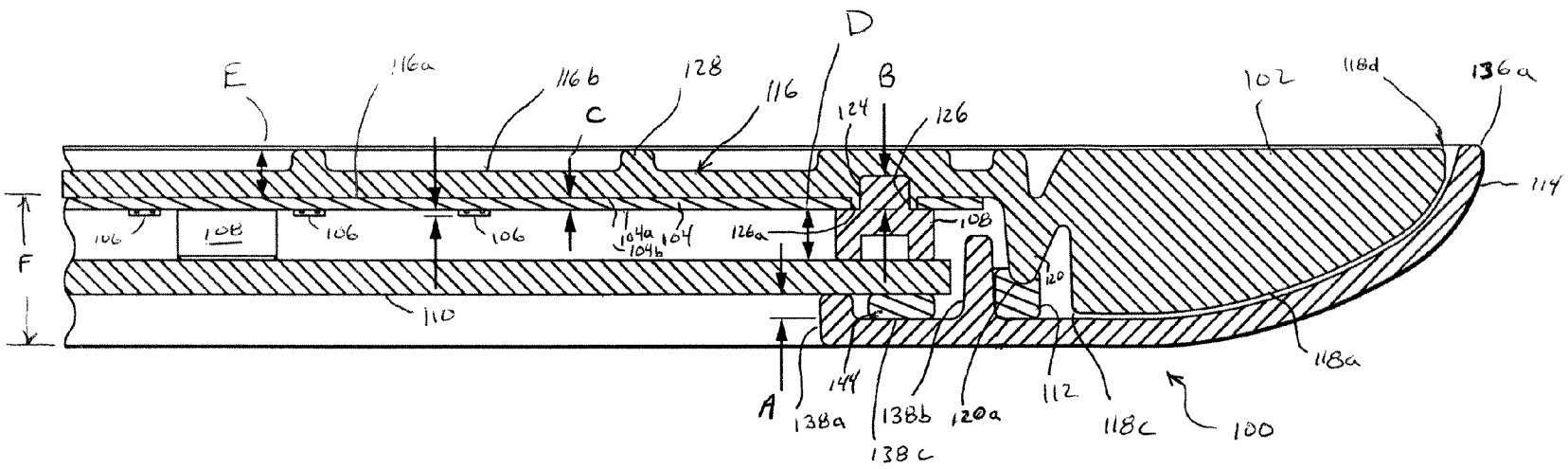
FIG. 4D is a cross-section of a portion of the luminaire depicted in FIG. 1A showing a greater width of the luminaire than FIGS. 4A-C.
Figure 4E:
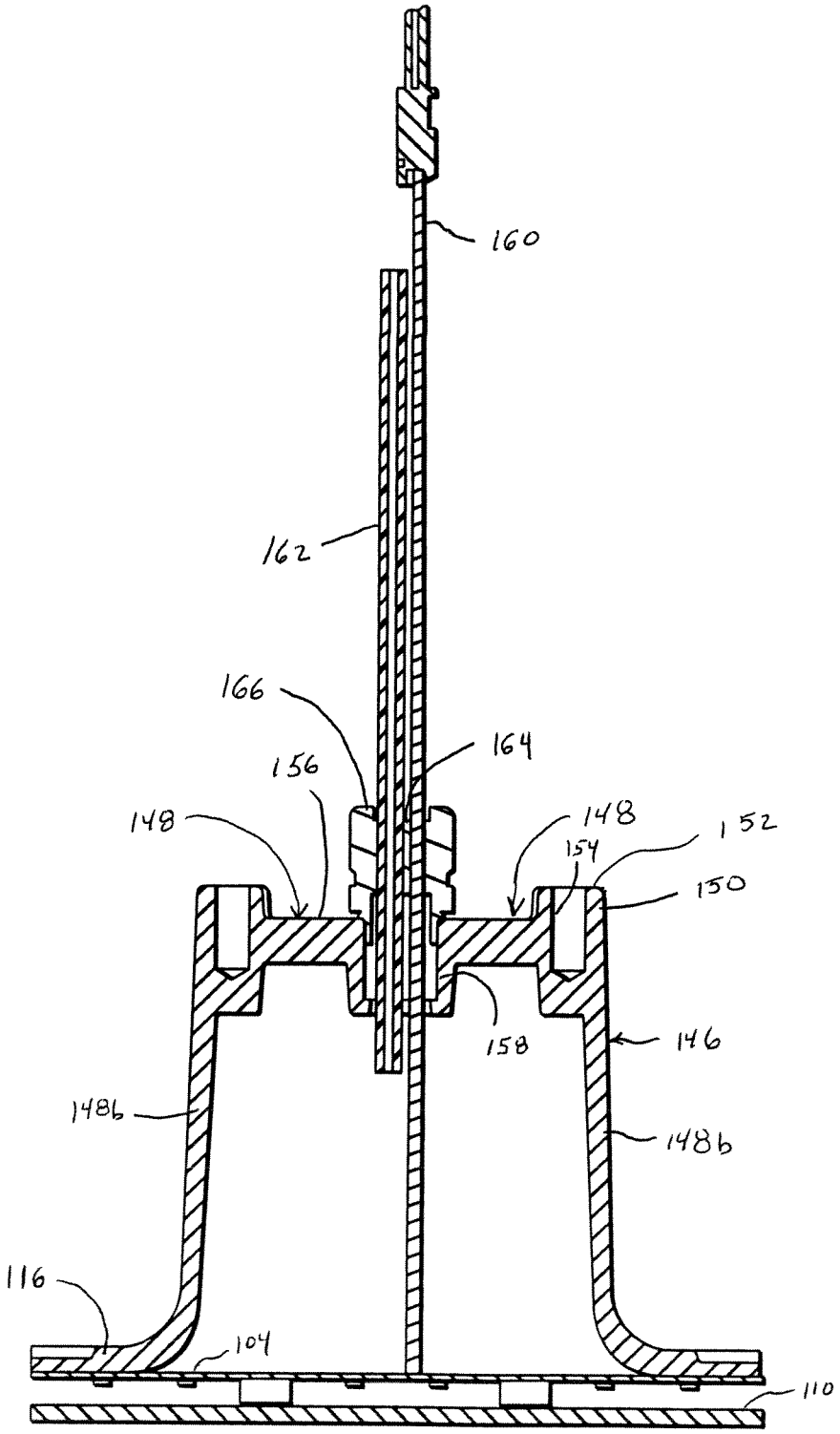
FIG. 4E is a cross-section of the housing stem of the luminaire depicted in FIG. 1A populated with wiring and breathing tube.
Figure 5A:
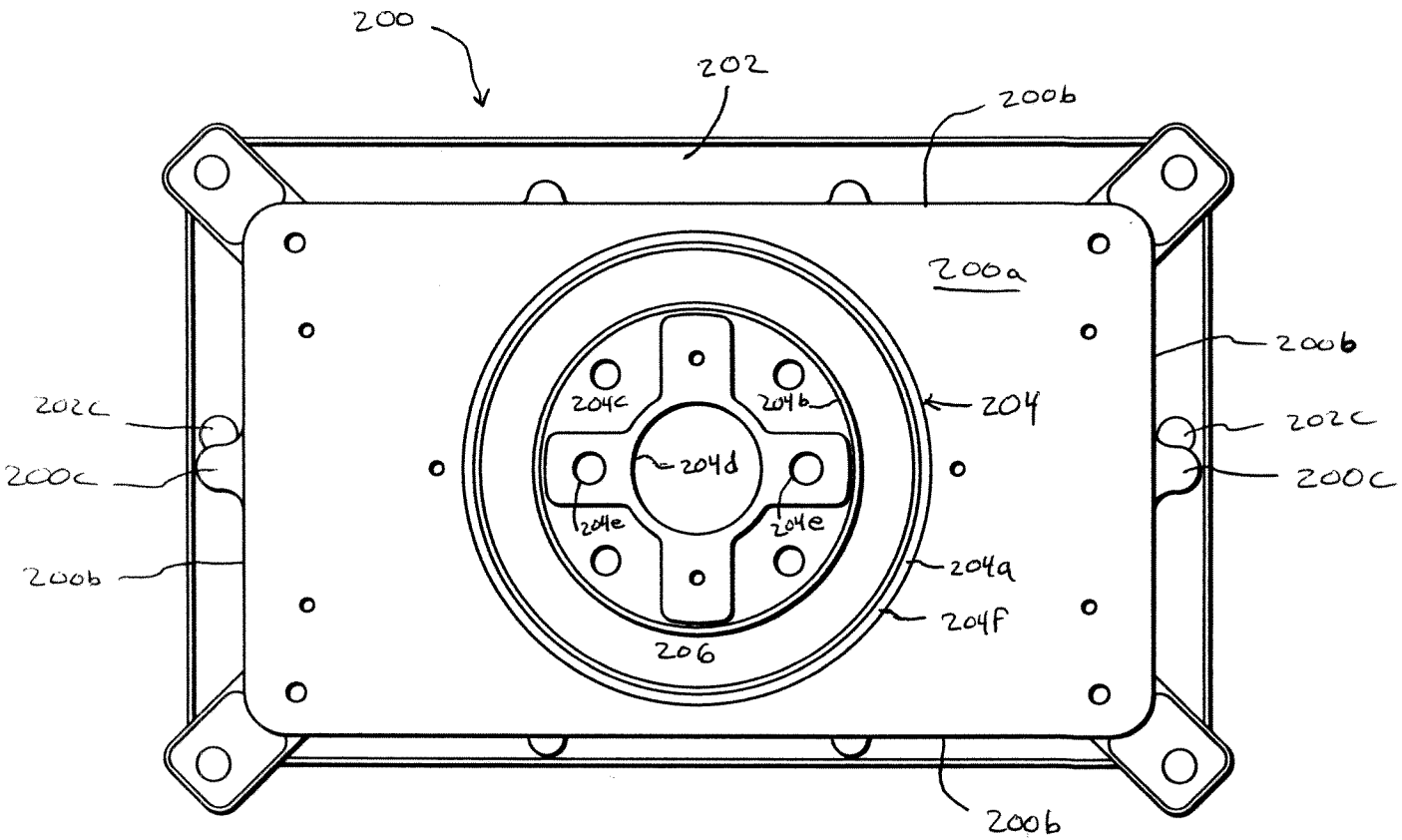
FIG. 5A is a bottom side view of the driver box and driver box stem depicted in FIG. 1B.
Figure 5B:
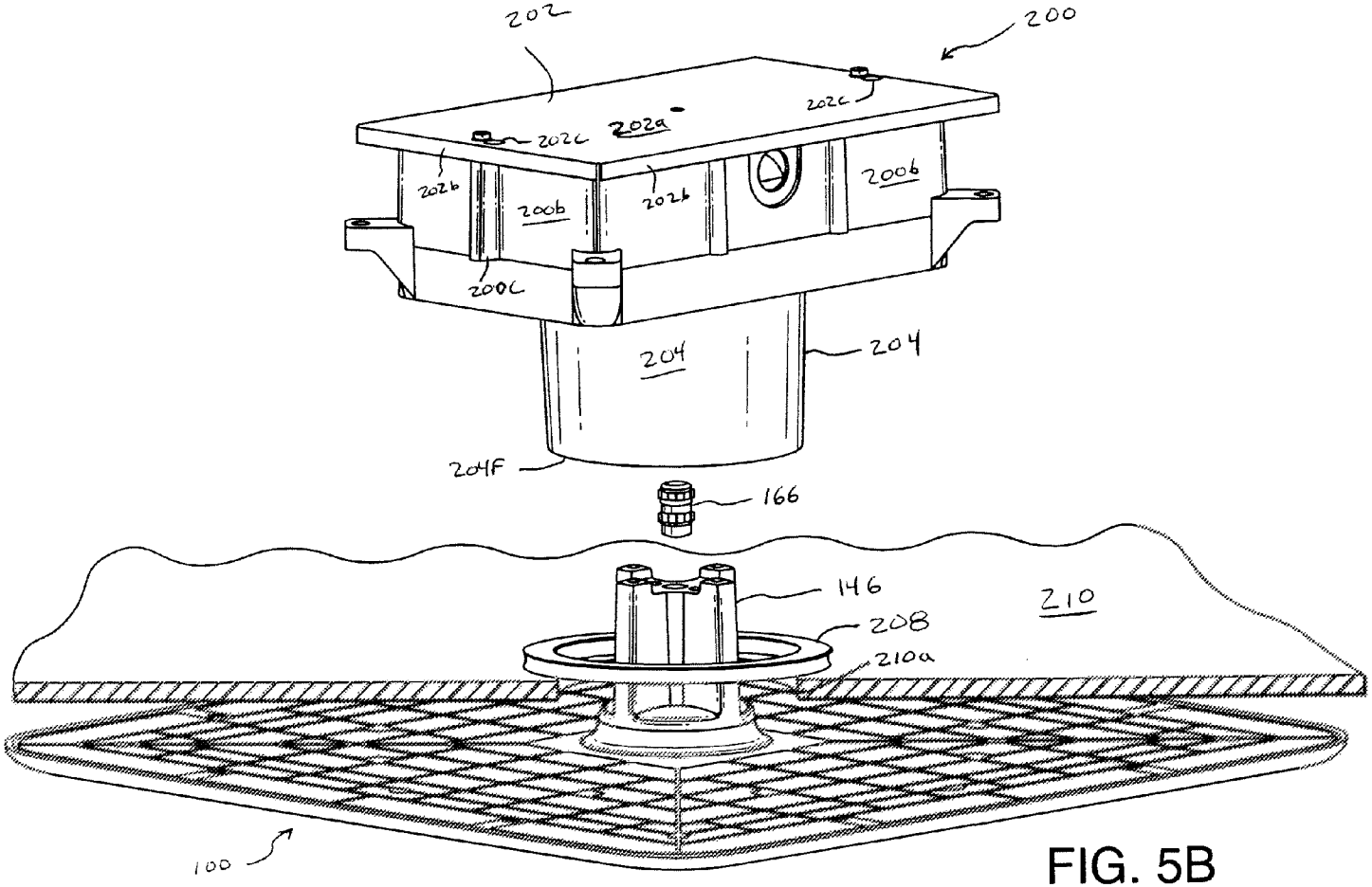
FIG. 5B is an exploded view of the luminaire depicted in FIG. 1A and the driver box and gasket depicted in FIG. 1C in the context of installation to a structure.

The housing plate 116 has a front face 116*a* and a rear face 116*b*. The housing plate front face 116*a* is substantially flat, extending across and filling in the perimeter 118, with the exception of a plurality of mounting holes 124 defined therein and a spacer boss 126 surrounding and extending each mounting hole 124 out beyond the housing plate front face 116*a*. Each spacer boss 126 comprises a cylindrical wall extending downward from the housing plate front face 116*a* to a distal end 126*a* and configured so that an inner wall of the spacer boss 126 continues the inner wall of the corresponding mounting hole 124 so that the spacer boss 126 effectively extends the depth of the mounting hole 124 to a depth B. In the depicted embodiment, the spacer boss distal end 126*a* sits approximately even with a front face 104*a* of the PCB (as depicted in FIGS. 4A and 4D), thus acting to space the head of the screws 108 a distance approximately equal to the thickness of the PCB, shown as distance C in FIG. 4D, to the PCB front face 104*a*. In one exemplary embodiment, distance B can be 0.125 inches, where the distance C can be 0.047 inches. In another exemplary embodiment, height of the spacer bosses 126 is just short of the thickness of the PCB 104 so that the screws 108 not only hold the PCB 104 from falling off the housing 102, but also hold it steady, preventing rattle of the PCB 104 and creating a heat transfer connection between the PCB 104 and the housing 102 causing the housing 102 to act as a heat sink for the PCB 104 and the LEDs 106 mounted thereon. These objectives are enhanced when the screws 108 are constructed of a pliable material, as discussed below. The height of the spacer bosses 126 could be 0.002 inches shorter than the thickness of the PCB 104 in one embodiment. Other dimensions are contemplated to meet these objectives.

In an alternative embodiment, no spacer bosses 126 are employed. However, the spacer bosses 126 provide two advantages. First, the spacer bosses 126 reduce assembly time by allowing screws 108 to be driven into the mounting holes 124 without regard for when they reach the PCB 104. Without the spacer bosses 126, advancing the screws 108 would be conducted with concern about advancing them too far or with too much power, either of which might damage the PCB 104. The spacer bosses 126 obviate that concern by allowing the screws 108 to be advanced to the spacer boss distal end 126*a* as quickly and efficiently as possible. This ease of securing the screws 108 to the housing 102 without damaging the PCB 108 is further advanced by using screws 108 of a pliable material such as, by way of example only, nylon. Use of such pliable screws 108 will allow the screws 108 to be advanced without regard for exactly when advancement need stop. That is, over advancing the screws 108 will not "strip" the mounting holes 124 or damage the screws 108 to an extent such to prevent them from holding the PCB 104 to the housing 102. Instead, by using screws 108 of a pliable material, over advancing the screws will slightly deform the threads of the screws 108, but not so much as to prevent the pliable threads of the screws 108 from grasping the inside of the mounting holes 124.

Moreover, in the depicted embodiment, the inner wall of the mounting holes 124 is straight (i.e. is not threaded). This further limits production costs by removing the need to tap the mounting holes 124 or create a complicated mold having reliable threads in the mounting hole 124. Additionally, using straight mounting holes 124 actually allows shallower mounting holes 124 because the use of a typically tap to create the threads in a mounting hole requires a certain depth in order to facilitate the tapping. Using straight holes eliminates the need to be able to tap the mounting holes 124, thus allowing shorter mounting holes 124 than could otherwise be used. In one exemplary embodiment, the depth B of the mounting holes 124 is 0.125 inches. Furthermore, by using the spacer bosses 126 to extend the wall of the mounting hole 124 out to the face of the PCB 104, the depth of the mounting hole 124 is moved into the luminaire 100, reducing the distance that the mounting hole 124 need extend toward the housing plate rear face 116*b*, thus allowing a thinner overall luminaire 100. Moreover, using pliable screws 108 in straight mounting holes 124 further reduces, or eliminates, the likelihood of damaging the screws 108 by over advancement.

The second advantage provided by the spacer bosses 126 is their inherent ability to reduce tolerances in the stack of elements (housing 102, PCB 104, screws 108, lens 110 and lens frame 114) contributing to the over all height of the luminaire 100, and thus its low-profile. As discussed in greater detail below, tight stack of these element contributes to the low-profile. The ability to advance the screws 108 against the spacer bosses 126 without exception so as to limit the tolerances necessary and contribute to an overall low profile. The additional cost of these spacer bosses is negligible in an embodiment where the housing is cast from a material (e.g. aluminum).

The housing plate rear face 116*b* is also substantially flat, with the exception of a matrix of interconnecting walls 128 extending from the rear face 116*b* a short distance off that face. This matrix 128 increases the overall rigidity of the plate 116 and thus the housing 102. The matrix 128 also provides additional surface area on the rear of the housing 102 to increase the ability of the housing to dissipate heat when any of the matrix 128 is exposed to ambient air. The matrix 128 also assists in providing surface contact with structure to which the housing is mounted when that structure has surface irregularities (i.e. is not flat). This surface contact can also be helpful in directing heat away from the luminaire 100 in installations such as a petroleum refill station canopy which is constructed of sheet metal and much of the sheet metal, except where contacted by the housing, is exposed to ambient air to facilitate transferring to the surrounding air, some of the heat generated by the light sources or utilities for powering the light sources.

The matrix 128 may optionally include bosses 130 at the bottom of the mounting holes 124. These bosses 130 provide additional thickness to account for molding irregularities.

In the depicted embodiment, the housing perimeter rear face 118*b* follows the curvature of the housing perimeter front face 118*a* for the most part. A cross-section of one embodiment is depicted in FIG. 4C. This embodiment keeps the perimeter thin and reduces material usage while the curvature provides structural rigidity. Other shapes and thicknesses are contemplated. The housing perimeter rear face 118*b* also includes the backside of the locator groove wall 122*a* and locator groove base 122*b* protruding therefrom.

As discussed above, one or more of the locator groove bases 122*b* define a screw aperture 132 to accommodate a screw 134 to extend through the housing 102 and into the lens frame 114 to secure the lens frame 114 to the housing 102. In the depicted embodiment, the screw 134 enters from the housing and extends into the lens frame 114 so as to not be visible from the front side of the luminaire 100. A cross-section of this embodiment is depicted in FIG. 4B. Other embodiments are contemplated.

In order to minimize the number of screws 134 necessary for assembly and minimize the corresponding assembly steps, one or more fins 136 may extend across the housing perimeter rear face 118*b* to fill in the back side of the housing perimeter 118 curvature and provide the housing perimeter 188 with added structural rigidity. In the depicted embodiment, each side of the square housing comprises a single such fin 136 between the two screws 134 and one such fin 136 at each rounded corner of the housing perimeter 118. A cross-section of this embodiment is depicted in FIG. 4A. Other embodiments are contemplated.

The lens frame 114 defines a front face 114*a* and a rear face 114*b* and comprises a lens frame perimeter 136 at the outermost perimeter of the lens frame 136 and a trough 138 defined by an inner trough wall 138*a* and outer trough wall 138*b*. The contour of rear face 114*b* of the lens frame perimeter 136 follows the contour of the housing perimeter front face 118*a*, extending to a distal end 136*a* that lies in approximately the same horizontal plane as the housing perimeter outer edge 118*d*. References herein to a "horizontal" plane are by way of describing relationships between elements and portions of elements in the disclosed luminaire 100 and the term "horizontal" is used because the luminaire 100 is described as being mounted to a ceiling or the like. Use of the term "horizontal" is not limiting on the luminaire 100 as it could be rotated to be mounted in any orientation. By extending the lens frame perimeter distal edge 136*a* to the housing perimeter outer edge 118*d*, the lens frame can cover the housing perimeter 118 from view to provide the luminaire 100 a simple and elegant aesthetic look as seen in FIG. 1A. One of more locator boss 140 extends rearward from the lens frame rear face 114*b* into the curvature defined by the lens frame perimeter 136. As described above, the locators grooves 122 of the housing 102 receive the locator bosses 140 to assist in properly locating the lens frame 114 on the housing 102 and, separately, to receive the mounting screw 134, which will remain hidden from sight to persons viewing the bottom of the luminaire 100, in the depicted embodiment. FIG. 4B depicts a cross-section of a portion of the luminaire 100 through a locator groove 122, a corresponding locator boss 140 and mounting screw 134. The lens frame 114 is oriented vertically at the distal edge 136 and then curves downward and inward with an ever increasing radius of curvature the farther it is from the distal edge 136 until it is oriented approximately horizontal where it is adjacent to the housing perimeter inner edge 118*c*.

A base 138*c* of the lens frame trough 138 continues to extend inward from the lens frame perimeter 136 horizontally and seamlessly from the lens frame perimeter 136. Other embodiments are contemplated. The lens frame trough inner trough wall 138*a* then extends vertically to define the lens frame innermost perimeter which defines a lens frame aperture 142 through which light emitted by the light sources 106 passes to leave the luminaire 100.

Figure 3A:
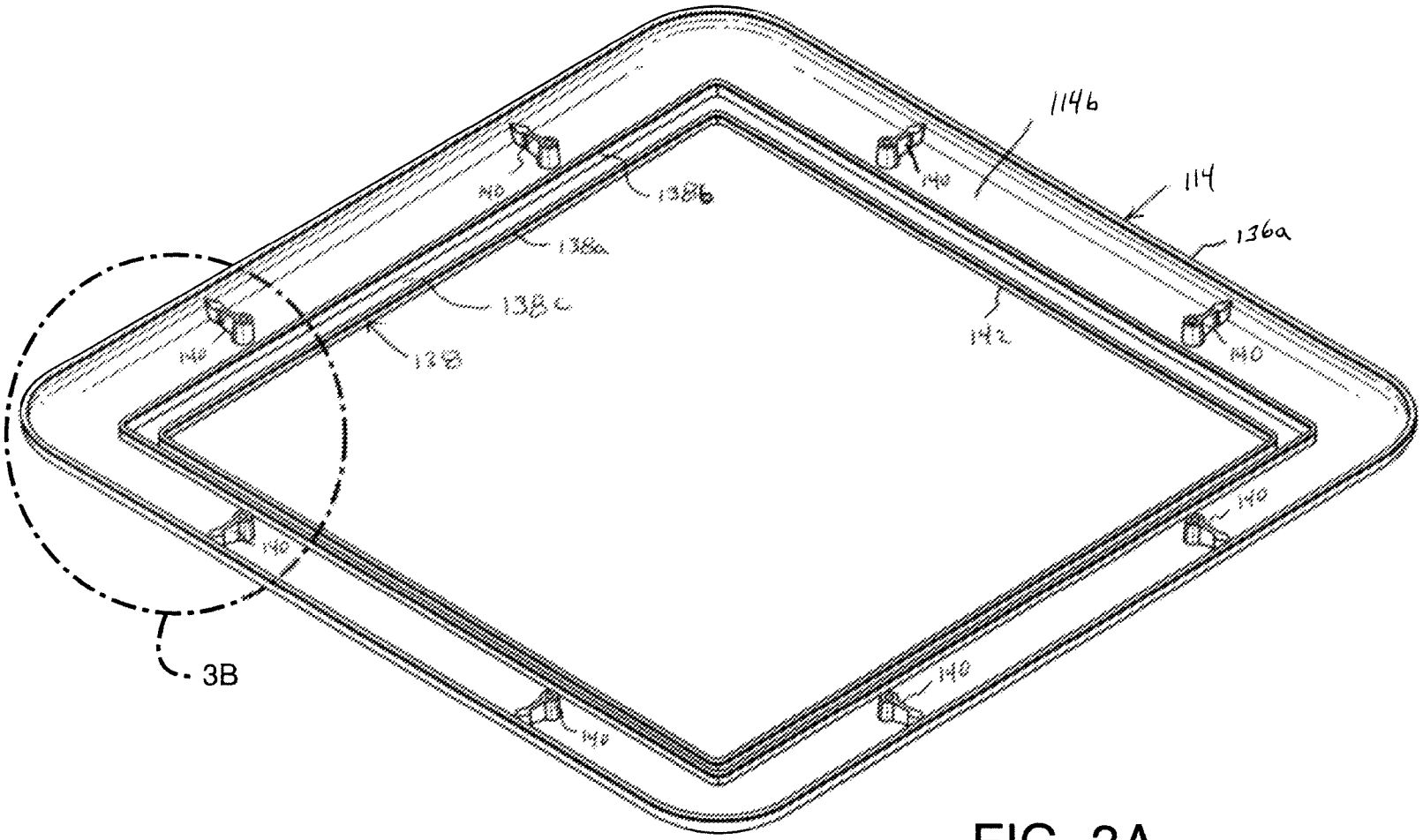
FIG. 3A is a top-side perspective view of a lens frame of the luminaire depicted in FIG. 1A.
Figure 3B:
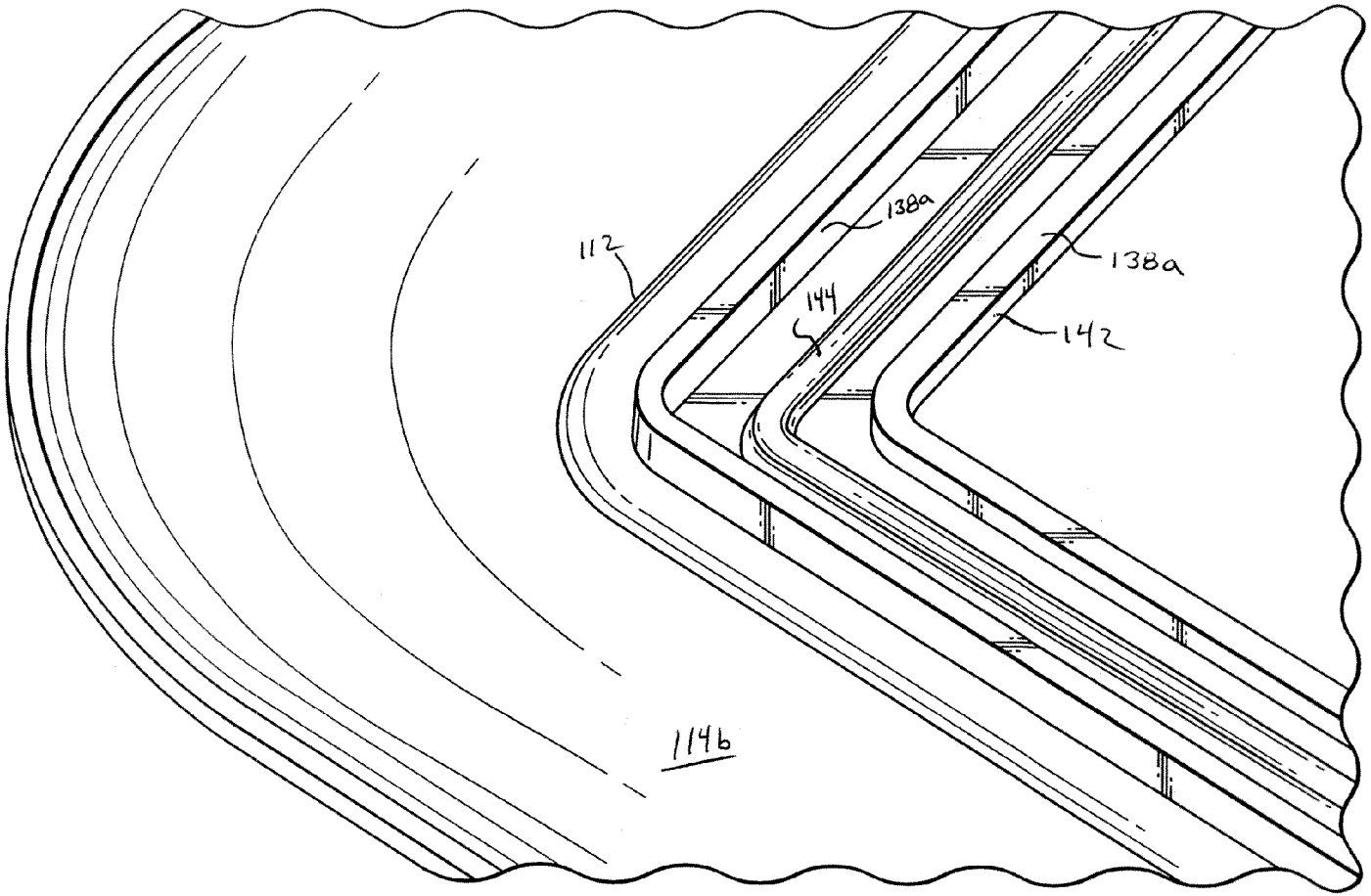
FIG. 3B is an outtake of a portion of the lens frame of FIG. 3A, with a gasket and adhesive sealant not depicted in FIG. 3A.

Gasket 112 is located about the perimeter of the trough outer wall 138*b* (depicted in FIG. 3B and FIGS. 4A-4D, but not FIG. 3A), which holds the gasket 112 in place during assembly. When the housing 102 and lens frame 114 are brought into alignment with, and secured one to the other, the housing wall 120 contacts and deforms the gasket 112. In the deformed state, the gasket 112 forms a seal against ingress of vapor, moisture, water or dirt between the housing 102 and the lens frame 114. The gasket 112 extends around the entire perimeter of the outer trough wall 138*b* and the housing wall 120 extends around the entire housing 102 such that the seal formed between the housing wall 120 and the gasket 112 extends about the entire perimeter of the PCB 104 preventing ingress of vapor, moisture, water or dirt between the housing 102 and the lens frame 114 that could reach the PCB 104 or other portions of the luminaire 100 within that perimeter seal. In an alternative embodiment, a urethane sealant could be substituted for the gasket 112. For the sake of efficiency, this urethane adhesive could be the same urethane adhesive as used in the trough 138, as discussed below.

The trough inner wall 138*a* extends upward a distance A (FIG. 4D) from the trough base 138*c* to a distal end on which the lens 110 rests. The lens 110 is sized so as to rest on the trough inner wall 138*a* distal end and extend almost all of the way to the trough outer wall 138*b*, leaving at least sufficient space there between to ease assembly. The trough outer wall 138*b* extends upward from adjacent the lens frame perimeter 136 and upward beyond the lens 110. The trough inner wall 138*a* is therefore shorter than the trough outer wall 138*b*. An adhesive sealant 144 is deposited into the trough 138 during assembly in a bead having a height sufficient so that when the lens 110 is placed on top of the bead, the lens 110 will deform the bead of adhesive sealant 144 until the lens 110 contacts and rests on the tough inner wall 138*a* distal end. The height of the trough inner wall 138*a* is a height A, and is designed to prevent the lens 110 from squeezing all of the adhesive sealant 144 out from between the lens frame 114 and lens 110 by limiting the distance between the lens 110 and the trough base 138*c* to height A. In this manner, the deformed bead of adhesive sealant 144 will have sufficient height to provide adhesion between the lens 110 to the lens frame 114. In one exemplary embodiment, the height A is 0.094 inches when using a 0.225 inch diameter bead of a urethane adhesive (SikaTack®-Ultrafast, sold by Sika Corporation, in one embodiment). In this embodiment, it has been found that the bead compresses to approximately the height A and approximately 0.425 inches, providing sufficient surface area to adhere to the lens 110. Other heights A, bead diameters and adhesive sealants are contemplated.

As depicted in FIGS. 4A-4D, the lens 110 in the assembled luminaire 100, is held by inner trough wall 138*a* and forced into contact with the head of the screws 108. In this depicted embodiment of the luminaire 100, the head of one or more of the screws 108 is sized (height of D) to facilitate this contact between the heads of the screws 108 and the lens 110. This contact holds the screws 108 in the mounting holes 124 and eliminates the need for any holding force between the screws 108 and the mounting holes 124 once the luminaire 100 is assembled. The need for only short term holding force between the screws 108 and mounting holes 124 can further reduce the requirements of the mounting hole 124 and the screws 108 allowing them to be even shorter and allowing an even thinner overall luminaire. The short term requirement for this holding force can also reduce the requirements of screws 108, reducing the overall cost of the luminaire 100. In one exemplary embodiment, the height of the screws is just sufficient to prevent the screws 108 from backing off the force with which they press on the PCB 104. In an alternative exemplary embodiment, the lens 110 increases the force with which the screws 108 press on the PCB 104. In one exemplary embodiment, the height D of the head of such screws 108 is 0.190 inches. Alternative embodiments are also contemplated in which the screw 108 is not held by the lens 110 or are rivets through the PCB 104 and through a hole (not depicted) in the housing 102. Other attachment hardware is also contemplated.

The PCB 104 comprises a PCB front face 104*a* populated with LEDs 106 and a PCB rear face 104*b*. The PCB rear face 104*b* is pressed into contact with the housing 102 by the screw 108 to create sufficient contact between the PCB 104 and the housing 102 to allow the housing 102 to act as a heat sink, taking away heat generated by the LEDs 106 and associated circuitry.

With the exception of the LEDs 106, the PCB front face 104*a* is covered with a reflective coating or covering. In one exemplary embodiment, the PCB front face 104*a* is covered with a white adhesive paper adhered to the PCB front face 104*a*. In another embodiment, the PCB front face 104*a* is covered with a sheet of reflective aluminum (not depicted). The reflective coating or covering covers the PCB from view while, at the same time, redirecting light off of the PCB front face 104*a* rather than absorbing it. Many luminaires, especially those using LEDs, place reflectors or optics near the light sources to redirect light emitted from the light sources to travel out of the luminaire. When using this reflective coating or covering discussed above, the luminaire of the present disclosure does not use any such reflectors or optics. The absence of reflectors and optics allows the distance between the PCB 104 and the lens 110 to be set as low as desired, bounded only by the need to secure the PCB 104 to the housing 102. In this manner, the absence of any reflectors or optics further contributes to a thin (i.e. low-profile) luminaire 100.

In order to further reduce the overall height of the luminaire 100, the light sources are LEDs 106 comprised of 0.25 Watt LEDs rather than larger, more powerful LEDs. Historically, one challenge of using LEDs for area lighting has been that LEDs have traditionally emitted insufficient light to replace more conventional light sources such as incandescent or fluorescent. This deficiency has traditionally been overcome by the use of a matrix of LEDs. However, as the acceptance of LEDs for area lighting has become more accepted, technologies have been driven to increase the lumen output LEDs. As the technologies have advanced in this Manner, conventional thinking in the LED lighting industry has been to use the biggest and brightest LEDs available for area lighting. The luminaire 100 of the present disclosure takes advantage of the advances in technology, but bucks traditional thinking by using a larger number of smaller, low output LEDs 106 as opposed to a larger number of larger, higher lumen output LEDs. The use of these smaller, low output LEDs 106 provides the luminaire 100 two advantages.

First, many manufacturers currently manufacture and sell 1 Watt LEDs. For example, Nichia sells the NS9W383 1 Watt LED. This 1 Watt LED has a height of approximately 0.108 inches. Instead of using these, or other, 1 Watt LEDs, the LEDs 106 used by the luminaire 100 are 0.25 Watt LEDs. In one exemplary embodiment the LEDs 106 are Nichia NS2W757A LEDs. More LEDs 106 are required to provide the luminaire 100 the same lumen output than would be necessary if the 1 Watt LEDs were used. However, the 0.25 Watt LEDs 106 reduce the height of the LEDs by 0.086 inches, allowing further reduction in the overall height of the luminaire 100.

Figure 6:
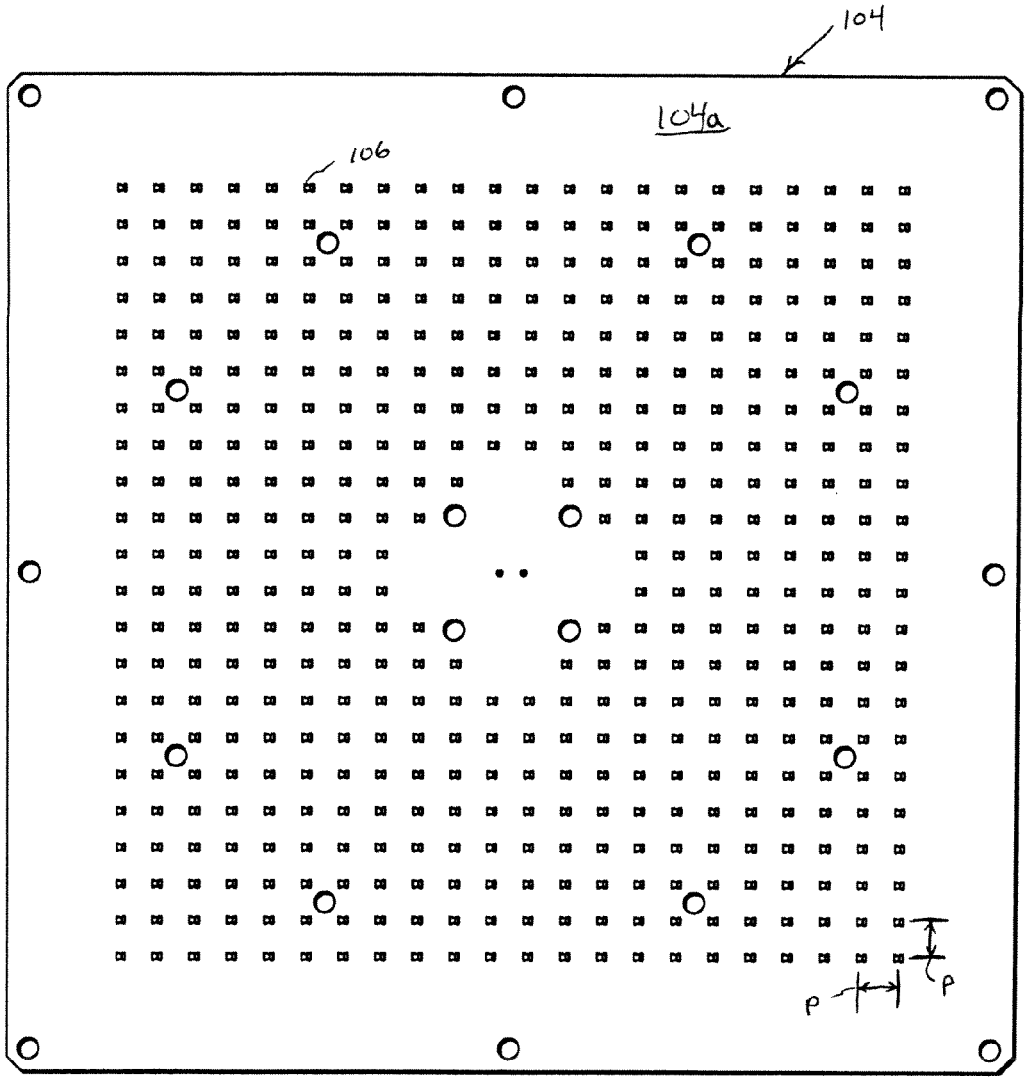
FIG. 6 is a bottom side view of the printed circuit board of the luminaire depicted in FIG. 1A.

In one embodiment of the disclosed luminaire depicted in FIG. 6, the PCB 104 is populated with 460 Nichia 0.25 Watt NS2W757A LEDs arranged in a matrix spacing them at a pitch of 0.625 inches. When driven at 530 mA, these 460 LEDs emit approximately 37 lumens each for a total of approximately 17,000 lumens. When driven at 650 mA, these 460 LEDs emit approximately 44 lumens each for a total of approximately 20,240 lumens.

Second, it has been found that the larger number of lower Watt and lumen LEDs 106 provide a more even light distribution that is more pleasant to the eye. This more even glow can be expressed as a ratio of the lumens (L) per LED 106 to the pitch (P) of the LEDs 106. In the embodiments disclosed in the preceding paragraph, each of the 460 LEDs are spaced at a pitch P of 0.625 inches. When these LEDs are driven at 530 mA they produce approximately 37 lumens each for a ratio of 59.2 lumens/inch. When these same LEDs are driven at 650 mA they produce approximately 44 lumens each for a ratio of 70.4 lumens/inch. Other lumen outputs per chip and pitches are acceptable. It has been found that a UP ratio of between approximately 59.2 lumens/inch and approximately 70.4 lumens/inch provide a combined even glow when the 0.25 Watt LEDs are illuminated. This ratio is contemplated as applicable to LEDs of other small wattage.

The accumulation of the above discussed advantages of the disclosed luminaire 100 result in an overall thin (i.e. low profile) luminaire 100. With the height E between the rear of the housing 102 and the housing plate front face 116*a* (0.193 inches in one exemplary embodiment) minimized to the thickness of a plate necessary for molding the mounting holes 124 in the housing plate front face 116*a* and the matrix 128 on the housing place rear face 116*b*, the height E can be less than 0.2 inches and it has been found that a height of 0.193 inches is optimal. Furthermore, use of pliable screws 108, with straight mounting holes 124, spacer bosses 126, thin LEDs 106 and a lens frame trough 138 having an inner trough wall 138*a* working in conjunction with the screws 108 to precisely control the height of the lens 110 with respect to the PCB 104 and the lowermost extremity of the lens frame aperture 142 creates a high precision, low tolerance stack of parts that facilitate a precisely thin luminaire 100 that eliminates the need for reflectors or optics thus further reducing the thickness of the luminaire 100. The height F between the housing plate front face 116*a* and the lowermost extremity of the lens frame aperture 142 (0.510 inches in one embodiment) is thus minimized and in conjunction with the minimized height E, provides an overall low profile, highly efficient luminaire 100. In the exemplary embodiment of height E being 0.193 inches and height F being 0.510 inches, the total height of the luminaire is only approximately 0.703 inches and is facilitated by one or more of the above discussed features.

The low height F, minus the low height C of the PCB 104 provides a very low height between the base of the LEDs 106 and the lowermost extremity of the lens frame aperture 142 through which light rays emitted from the LEDs 106 escape the luminaire 100. This resulting low height allows most of the lumens emitted from the LEDs 106 to escape the luminaire 100 without need for reflectors or optics. In the example identified above using 460 Nichia 0.25 Watt NS2W757A LEDs driven at 650 mA to emit a total of 20,240 lumens, it has been found that of the 20,240 emitted lumens, 20,195 escaped the luminaire 100 in this configuration.

In one embodiment of the disclosed luminaire, a driver column 146 extends upward from the rear of the housing plate 116. The driver column 146 may be integral with the housing plate 146 or not integral. In the depicted embodiment, the driver column 146 is integrally cast as part of housing 102. The driver column 146 comprises four wings 148 extending radially from a central axis of the driver column 146. The driver column 148 could comprise greater or fewer wings 148; three in one exemplary embodiment. Each wing 148 extends upward from the housing plate 116, having opposing lateral walls 148*a* and a circumferential wall 148*b* at the circumferential perimeter of the driver column 146. In the exemplary depicted embodiment, the circumferential wall 148*b* extends approximately tangential to the circumference of the driver column 146 and the opposing lateral walls 148*a* extend approximately perpendicular to the circumferential wall 148*b* inward generally toward the central axis of the driver column 146. The entire driver column 146, including the wings 148, are depicted as hollow, which is a result of the cost savings available by producing the housing 102, including the driver column 146 as an integral, unitary casting. Other embodiments are contemplated, however. For example, the wings could be solid and/or secured to the housing in an alternative embodiment.

Each wing 148 defines a mounting boss 150 at its top 152 for receiving fixing hardware for mounting a driver box 200 to be associated with the luminaire 100 during installation. In the depicted embodiment, the mounting boss defines a screw hole 154 for receiving a screw, but other fixing hardware is contemplated in the alternative. The mounting boss 152 is limited to the outer portion of each wing 148, leaving a recessed land 156 defined by the four mounting bosses 152.

An aperture 158 is defined at the center of the driver column 146 through the land 156 to allow utilities to pass from the luminaire 100 to the driver box 200. For example, wiring 160 to provide power to the light sources passes through the aperture 158 to deliver power from a driver located in the driver box 200 to the light sources.

In an exemplary embodiment, the aperture 158 is designed to allow air to pass therethrough, even when the wires 160 are present. Air expands and contracts as it is heated and cooled, respectively. As discussed above, the seal created by gasket 112 seals the air in the portions of the luminaire 100 inward of the gasket from the ambient environment. Thus sealed, the expansion and contraction of this sealed air would create air pressure above or below the ambient air pressure unless that sealed air was somehow vented. If the air pressure of this sealed air were to fall below the ambient air pressure, then the luminaire 100 would tend to try to draw air outside the luminaire, along with any dirt, moisture, etc. into the luminaire. Over time, this could tend to break down the seal created by the gasket 112. Allowing air to pass through the driver column aperture 158 allows the luminaire 100 to breath and prevents the luminaire 100 from trying to draw moisture across the seal created by the gasket 112.

In one particular exemplary embodiment of the luminaire 100, a breathing tube 162 is run through the aperture 158 along with the wiring 160 and a sealant 164 fills the remainder of the aperture 158 so that no moisture, air, dirt, etc. can pass through the aperture unless through the breathing tube 162. In one embodiment, the sealant 164 is the same urethane adhesive discussed above. In another embodiment, the sealant 164 is an elastomer. Other sealants 164 are contemplated. In yet another exemplary embodiment, a cylindrical gland 166 having a sealant 164 therein is screwed into threads formed in the aperture 158 and the breathing tube 162 and wiring 160 are run through the sealant 164, which forms a tight seal around the breathing tube 162 and wiring 160 to prevent ingress of any dirt, moisture, air, etc. into the luminaire 100. The gland 166 could be a commercially available liquid tight fitting for individual conductors such as a Conta-Clip brand model PG9, in one example. Other embodiments are contemplated. Regardless of how the sealant 164 is provided, the breathing tube 162 is run into the driver box 200 to prevent rain water, dirt, etc. from entering the breathing tube 162 and running down into the luminaire 100.

The driver box 200 comprises a box having a bottom wall 200*a* and perimeter walls 200*b* creating an upwardly open box. The driver box 200 is closed by a cover plate 202 having a central plate 202*a* and downwardly depending edges 202*b* along each side of the central plate 202*a* to direct water, snow, etc. downward past the opening to the driver box 200. In one exemplary embodiment, the central plate 202*a* extends outward beyond each wall 200*b* of the driver box to further prevent water, snow, etc. from entering the driver box. The driver box comprises mounting hardware to facilitate securing the cover plate 202 to the driver box 200. In one embodiment, the driver box 200 comprises driver box ears 200*c* extending from one or more driver box walls 200*a* and defining a hole therein to receive a screw for securing the cover plate 202 to the driver box 200. In the depicted embodiment, driver box ears 200*c* extend from two opposing ones of the driver box walls 200*a*. By extending the driver box ears 200*c*, and thus the hole in the cover plate 202 to accommodate the screws, outward beyond the driver box walls 200*a*, any rain, snow, etc. falling through the hole in the driver box cover plate 202 will fall outside of the driver box 200 rather than into the driver box 200. In one possible embodiment, the driver box ears 200*c* do not extend as high as the driver box walls 200*a*, but fall just short thereof. This prevents any water that may fall through the screw holes in cover plate 202 from traveling across the driver box ears 200*c* and into the driver box. Alternatively, the driver box ears 200*c* may extend as high as the driver box walls 200*a*, but have a groove extending across the driver box ears 200*c* between the screw holes and the driver box wall 200*a*.

A stem 204 extends downward from the driver box bottom wall 202*a*. In the exemplary depicted embodiment, the stem 204 is integrally cast with the driver box 200, but other options are contemplated. The stem 204 is configured to slide over the driver column 146 of the luminaire and accommodate the driver column 146 within the stem 204. In one embodiment, the stem comprises a wall 204*a* having an inner surface defining an opening 204*b* to receive the driver column 146. A top 204*c* of the opening 204*b* may be defined by the driver box bottom wall 202*a* (as in the depicted embodiment) or by a separate top 204*c*. The opening top 204*c* can be shaped to complement all or portions of the top of the driver column 146 so that the driver box 200 will sit securely on the driver column 146. The stem opening top 204*c* defines a utilities aperture 204*d* to accommodate the wiring 160 and the breathing tube 162 and gland 166, where present, allowing them to enter the driver box 200. The breathing tube 162 need only enter the driver box 200 and be protected from the elements by the driver box 200 and cover plate 202. The wiring 160 enters the driver box 200 through the utilities aperture 204*d* and is connected to a driver (not depicted) for providing power to the light sources. One or more hardware apertures 204*e* are defined in the top 204*c* and configured to allow screws or the like to pass through and secure into a corresponding one of the screw holes 154 on the driver column 146 to secure the driver box 200 to the driver column 146 and, thus, the luminaire 100.

In one embodiment, the stem wall 204*a* defines a lower edge 204*f* and a groove 206 about the entirety of the lower edge 204*f*. The groove 206 accommodates a gasket 208. In the depicted embodiment, the stem wall 204*a* is cylindrical and the groove 208 and corresponding gasket 208 are circular. Other embodiments are contemplated.

During installation to a structure 210, the housing 102 is elevated to the structure and the driver column 146 passed through an aperture 210*a* in the structure. The structure 210 could be, by way of example only, a ceiling or a canopy for a petroleum refill station. The structure aperture 210*a* could be a pre-existing aperture left over from a previously installed luminaire or it could be a newly constructed aperture. The gasket 208 rests in the groove 206 defined by the stem wall lower edge 204*f* and becomes compressed when brought into contact with the structure and the stem 204 tightly secured to the driver column 146. When in this compressed state, the gasket 208 forms a seal around the structure aperture 210*a* to prevent material above the structure (e.g. dirt, water, etc.) from getting to the structure aperture 210*a*. The ability of the gasket 208 to prevent material from getting to the structure aperture 210*a* in this manner is predicated on the gasket 208 and the groove 206, in which is resides, being larger than the structure aperture 210*a*. In one exemplary embodiment, the stem wall 204*a* is sized to allow the gasket 208 to circumscribe at least a 4 inch diameter structure aperture 210*a*, which is commonly left behind by pre-existing luminaires. Other dimensions are also contemplated. While this size stem is larger than necessary for some applications, it has also been found that the large size of the stem also assists in providing stability of the structure 210 when the structure is somewhat flexible, such as in a sheet metal canopy as is often found at a petroleum refill station.

The stem 204 is preferably of a height to elevate the driver box 200, or portions thereof, above the height where water, snow, etc. may be allowed to accumulate. For example, a sheet metal canopy a petroleum refill station will often accumulate some water and/or snow during precipitation before that water is directed off the canopy. The height of the stem is preferably designed so that the driver box 200 is above the height to which water and/or snow are likely to accumulate. In this embodiment, the driver within the driver box 200 is more likely to be kept dry than if the stem places the driver box 200 below that height.

A mounting apparatus 300 is depicted in FIGS. 7A-7G which can be used with the luminaire 100 described above, or with a different luminaire. For continuity, the mounting apparatus 300 of the present disclosure will be described in conjunction with the luminaire 100 previously described herein. The mounting apparatus 300 is beneficial in mounting a luminaire, such as luminaire 100, to a mounting structure 302, which may depend from another structure such as a ceiling or the canopy of a petroleum refill station.

Figure 7A:
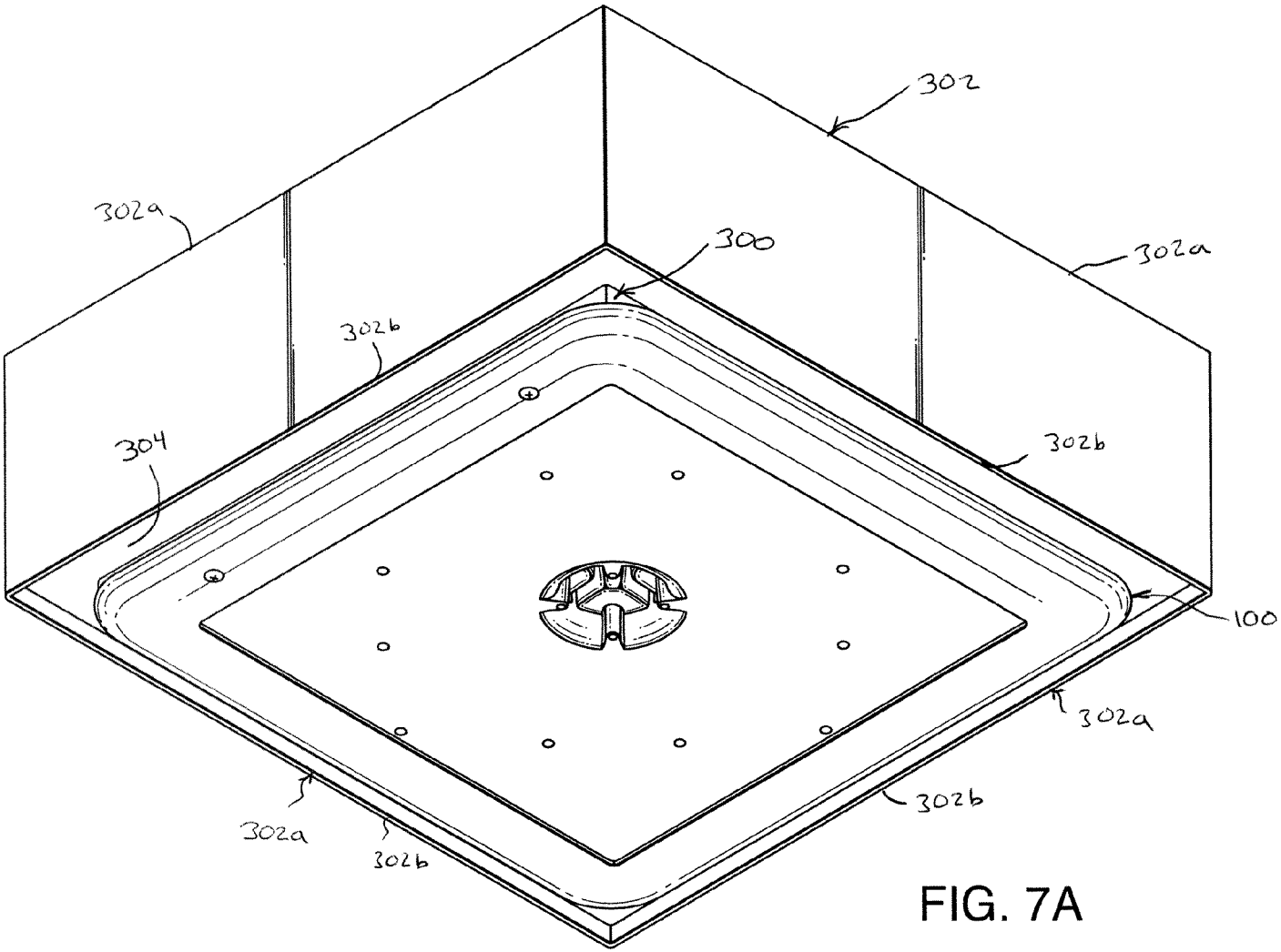
FIG. 7A is a bottom-side perspective view of the luminaire depicted in FIG. 1A mounted in a mounting structure.
Figure 7B:
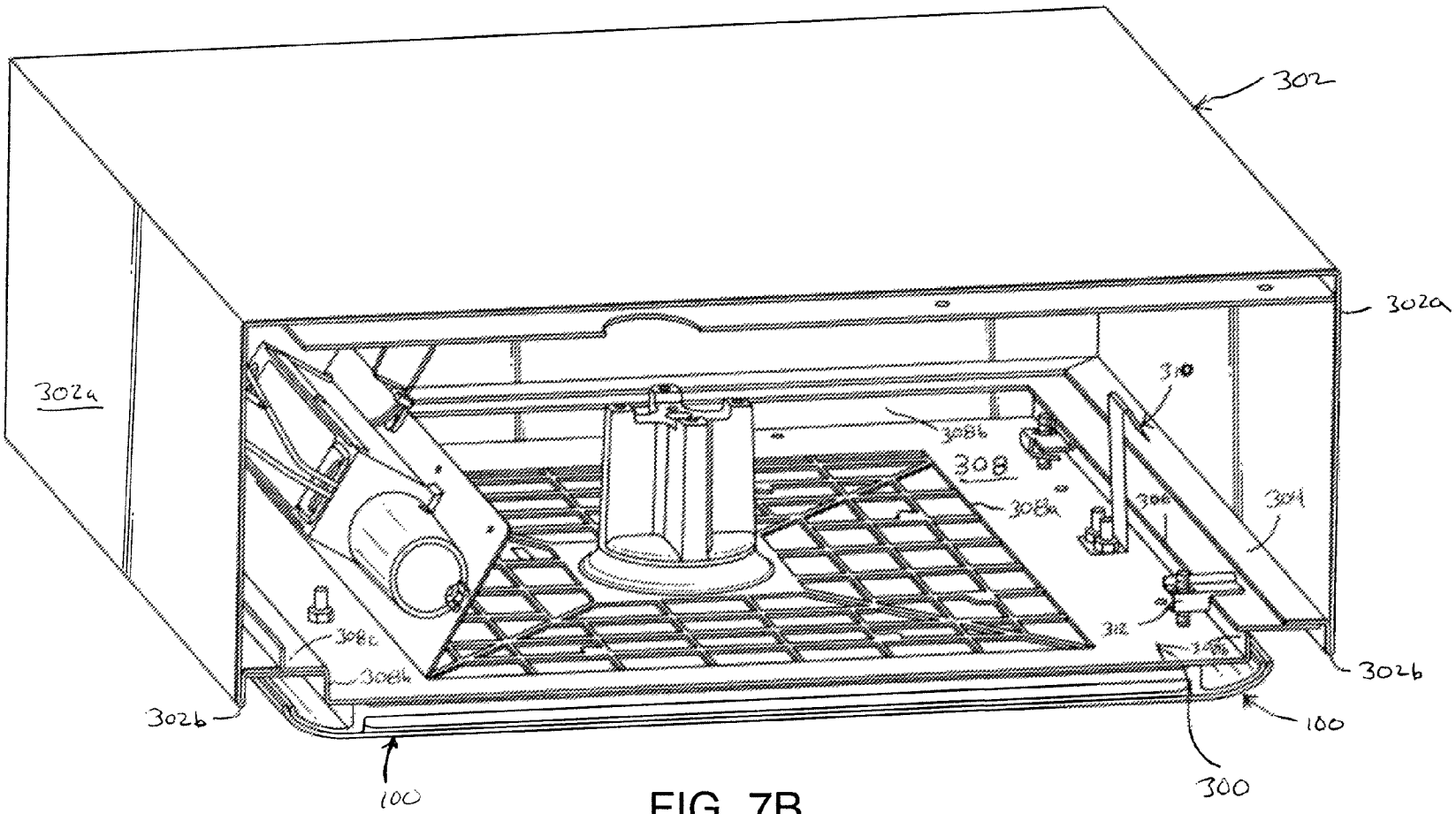
FIG. 7B is a perspective cross-sectional view of the luminaire and mounting structure depicted in FIG. 7A.
Figure 7C:
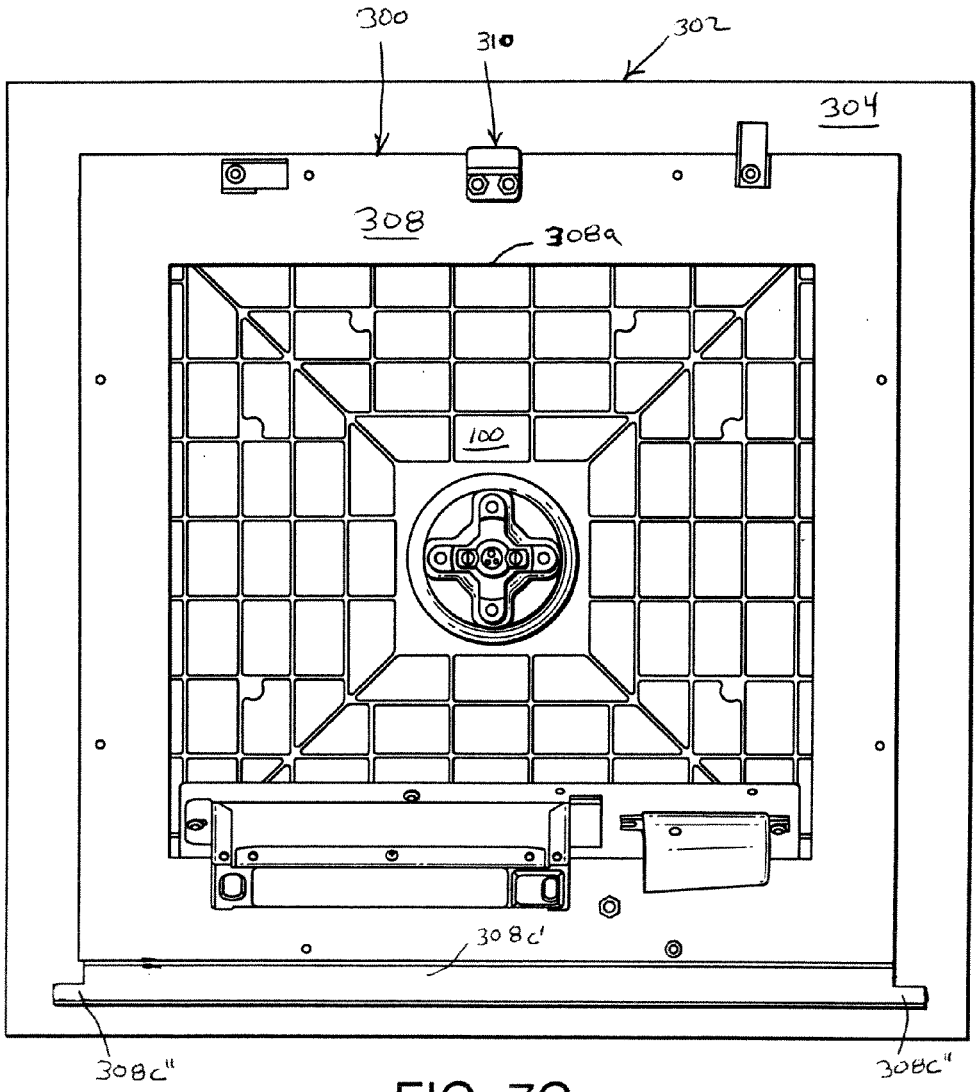
FIG. 7C is a top side view of the luminaire and portions of the mounting structure depicted in FIG. 7A.
Figure 7D:
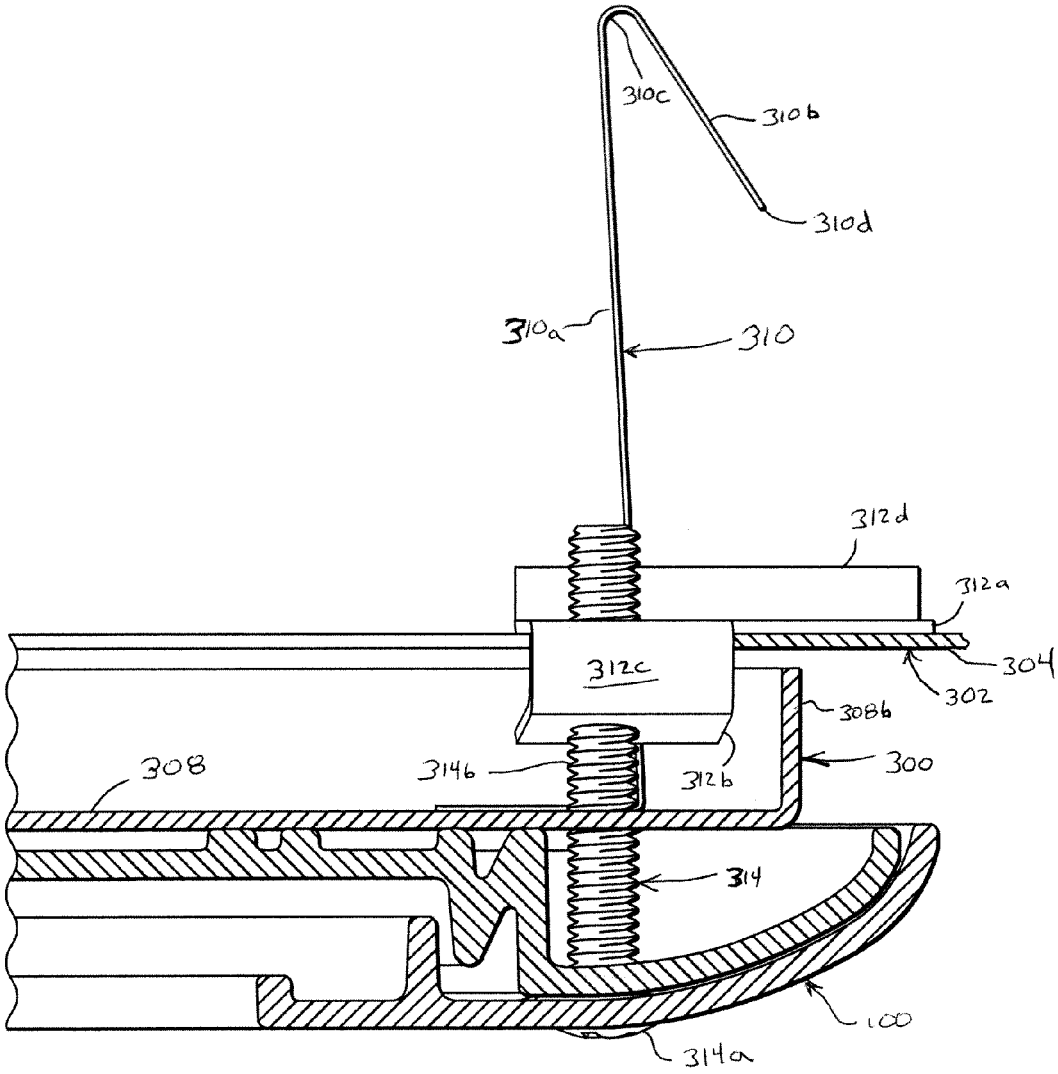
FIG. 7D is a cross-sectional view of portions of the luminaire and mounting structure depicted in FIG. 7A.
Figure 7E:
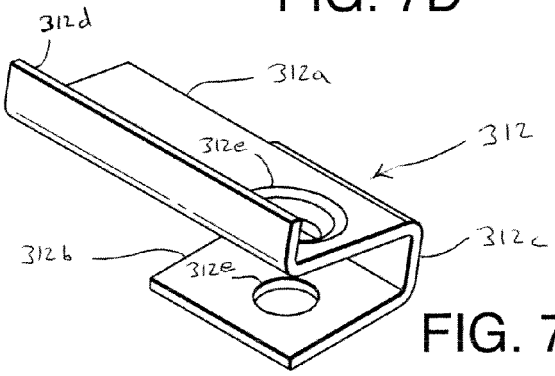
FIG. 7E is a perspective view of a locking wing of the mounting structure depicted in FIG. 7A.

The mounting structure 302 comprises four walls 302*a* forming a rectangular box, square in the depicted embodiment. The mounting structure 302 further comprises a face plate 304 extending between the four walls 302*a* slightly above their lower distal ends 302*b*. The face plate 304 lies generally horizontal and defines a face plate aperture 306. The face plate 304 can be separate from the walls 302*a* or extend integrally from the walls 302 as depicted in FIG. 7B. The mounting structure 302 can be a pre-existing mounting structure in which a different luminaire had been installed or can be newly constructed for installation of a luminaire such as the luminaire 100. However, the mounting assembly 300 finds particular use for installing modern LED-based luminaires (such as luminaire 100) in mounting structures such as mounting structure 302 which is typical for housing older model luminaires such as HID or incandescent luminaires.

The mounting apparatus 300 comprises a mounting plate 308 mounted to the back of a luminaire, such as luminaire 100. The mounting plate 308 optionally defines a mounting plate aperture 308*a* to allow portions of the luminaire to project through. In the depicted example, the driver column 146 of the previously described luminaire 100 is allowed to project through the mounting plate 308 due to the aperture 308*a*. Flanges 308*b* extend upward from each edge of the mounting plate 308 a short distance to contact, or come close to contacting, the mounting structure 302 when installed. A hinge flange 308*c* extends from a first of the flanges 308*b* and comprises an extending portion 308*c*' and wings 308*c*" extending from opposing sides of the extending portion 308". The extending portion 308*c*' does not extend to the ends of the first of the flanges 308*b*, but instead leaves clearance on both ends. The wings 308*c*" extend beyond the ends of the first of the flanges 308*b* and beyond the edges of the corresponding aperture 306 of the mounting structure face plate 304. In this configuration, the luminaire (such as luminaire 100) may hang from the mounting structure 302 by the wings 308*c*" and may rotate about those wings 308*c*". The clearance left on both ends of the extending portion 308*c*' provides clearance between the extending portion and the edges of the corresponding aperture 306 during rotation. During installation, this structure allows an installer to connect the wiring of the luminaire to the power source in the mounting structure 302. The mounting plate 308 can be mounted to the luminaire by screws or other hardware.

A catch 310 optionally extends from the mounting plate 308 adjacent to a second of the flanges 308*b* extending from the mounting plate 308 on a side opposite to the first of the flanges 308*b* from which the hinge flange 308*c* extends. The catch 310 comprises a stem 310*a* and a hook 310*b* extending from the flange. In the depicted embodiment, stem 310*a* is mounted to the mounting plate 308 and extend upward to a stem distal end 310*c*, while the hook 310*b* extends downward from the stem distal end 310*c* angled toward the face plate 302 and extending to a hook distal end 310*d* that lies outside of the face plate aperture 306 such that when the luminaire 100 is rotated downward from the mounting structure 302, the hook catches the face plate 304 and prevents the luminaire 100 from rotating further. A person seeking to rotate the luminaire 100 further may bend the stem 310*a* inward a distance sufficient to allow the hook distal end 301*d* to pass the face plate 304. When rotating the luminaire 100 into the mounting structure, the angle of the hook 310*b* causes the stem 310*a* to deflect inward as the hook 310*b* slides past the face plate 304, allowing the hook 310*b* to pass the face plate 304 and spring back to an unbiased position after passing the face plate 304. While the mounting apparatus 300 is beneficial without the optional catch 310, the catch 310 is preferable for the above discussed benefits. Other embodiments of a catch are also contemplated.

One or more lock wings 312 are optionally mounted to one lock screw 314 each, which extends vertically through the luminaire 100 and the mounting plate 308 at a location adjacent to the second of the flanges 308*b* extending from the mounting plate 308 on a side opposite to the first of the flanges 308*b* from which the hinge flange 308*c* extends. In the depicted embodiment, the mounting apparatus 300 comprises two lock wings 312, each mounted to one lock screw 314. Each lock screw 314 comprises a head 314*a* located at the face of the luminaire 100, making the head 314*a* accessible when the mounting apparatus 300 is in the closed position depicted in FIGS. 7A, 7B and 7D (i.e. fully mounted to the mounting structure 302). The lock screw 314 also comprises a threaded shaft 314*b* extending through the luminaire 100, through the mounting plate 308 and far enough above the mounting plate 308 such that it extends above the mounting structure face plate 304 when the mounting apparatus 300 is in the closed position.

Each lock wing 312 comprises a lock arm 312*a* and a stop arm 312*b* connected by a bridge member 312*c*. In the depicted embodiment, the lock wing 312 is constructed of sheet metal bent into a U-shaped configuration in which the lock arm 312*a* constitutes one leg of the U, the stop arm 312*b* constitutes the other leg of the U and the bridge member 312*c* constitutes the base of the U. In the depicted embodiment, an optional strengthening flange 312*d* extends along and perpendicular to the lock arm 312*a* to provide structural rigidity to the lock arm 312. Each of the lock arm 312*a* and the stop arm 312*b* define a screw aperture 312*e* for allowing the screw shaft 314*b* to pass through. Optionally, one or both of the screw apertures 312*e* is threaded so that the lock wing 312 can be threaded onto the screw shaft 314*b*. Alternatively, or in addition, the lock wing 312 can be mounted to the screw shaft 314*b* by other means, such as, by way of example only, adhesive.

Each lock wing 312 is mounted on the screw shaft 314*b* at a distance from the screw head 314*a* that will locate the lock arm 312*a* slightly above the mounting structure face plate 304. In this configuration, each lock wing 312 can be rotated about the central axis of its corresponding screw 314 by rotating the screw head 314*a* of the corresponding screw 314. Rotating the lock wing 312 can bring the lock arm 312*a* over the mounting structure face plate 304 or over the aperture 306 defined in the mounting structure face plate 304. When the lock arm 312*a* is over the mounting structure face plate 304, the lock arm 312*a* prevents the luminaire 100 from rotating about the wings 308*c*" of the hinge flange 308*c*, thus keeping the luminaire 100 secure to the mounting structure 302. However, when the lock arm 312*a* is over the aperture 306 defined in the mounting structure face plate 304, the luminaire 100 may freely rotate about the wings 308*c*" of the hinge flange 308*c*, thus allowing access to the luminaire 100 or removal of the luminaire 100 from the mounting structure 100 (with the above described manipulation of the optional catch 310, if present). In this configuration, locking and unlocking the luminaire 100 to the mounting structure 302 requires only a ninety degree) (90° rotation of the screw head 314*a*. The stop arm 312*b* assists a person seeking to lock the luminaire 100 to the mounting structure 302 by contacting the adjacent mounting plate flange 308*b* before the lock arm 312*a* has rotated too far. In this manner, the stop arm 312*b* stops rotation of the lock wing 312 at the appropriate location so that it does not continue rotation and end up over the face plate aperture 306. In the embodiment in which one or more of the screw apertures 312*e* of the lock wing 312 are threaded to the screw shaft 314*b*, the stop arm 312*b* prevents rotation of the lock wing 312 and continued advancement of the screw 314 would draw the lock wing 312 closer to the screw head 314*a* drawing the luminaire 100 closer to the mounting structure face plate 304, allowing a person to tighten the luminaire 100 up against the mounting structure face plate 304, or leave an gap there between at the option of the person. FIG. 7B depicts one lock wing 312 in the locked position and one lock wing 312 in the unlocked position. Other configurations and operations of the lock wings 312 are contemplated.

Optionally, the driver and/or other utilities can be mounted to the mounting plate 308. In the depicted exemplary embodiment, the mounting plate 308 comprises a driver flange 308*d* extending upward from the mounting plate and the utilities are attached thereto. By extending the driver flange 308*d* upward of the mounting plate, the driver is separated from the luminaire housing to remove the heat of the utilities from the housing. The driver flange 308*d* may also act as a heat dissipation fin to dispel heat from the luminaire housing into the mounting apparatus 300.

Figure 7F:
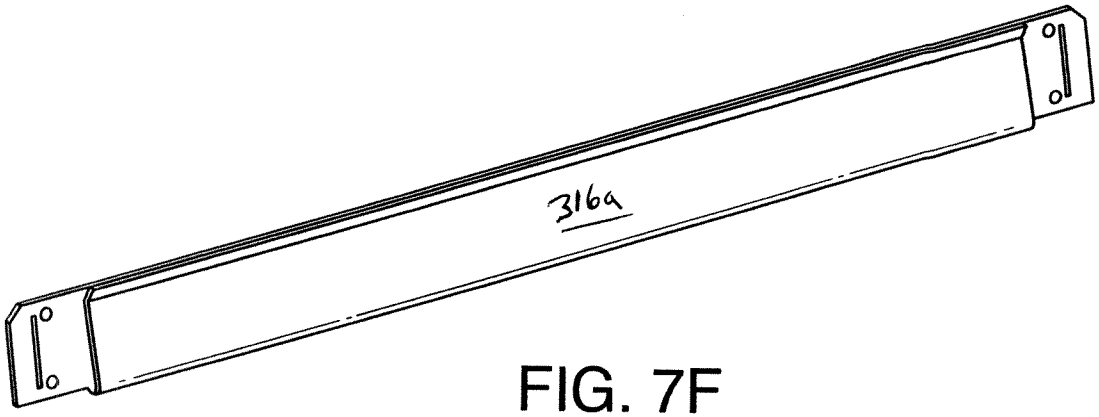
FIGS. 7F and 7G are perspective views of optional mounting structure extensions of the mounting structure depicted in FIG. 7A.
Figure 7G:
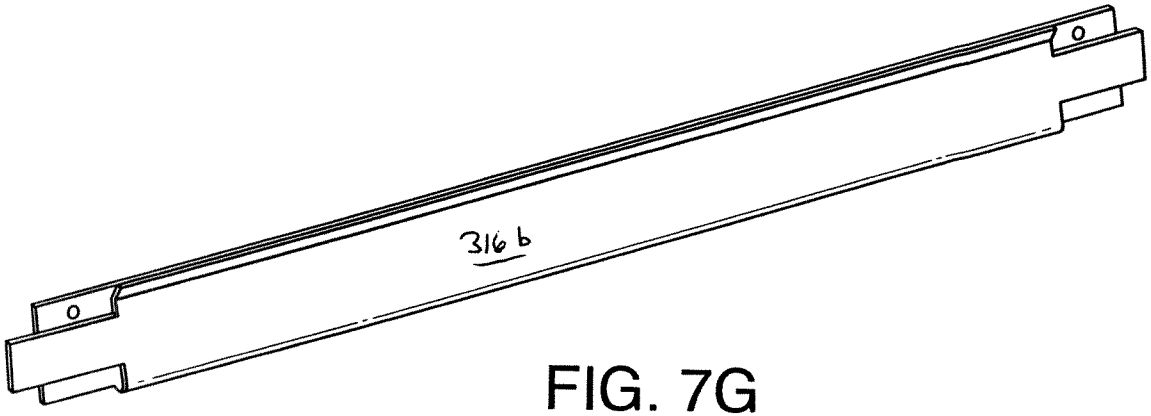

FIGS. 7F and 7G depict optional mounting structure extensions 316*a*, 316*b* that may be mounted to the inner edge of the mounting structure face plate aperture 306 to extend the edges of that aperture 306 inward if slightly larger than desired for an appropriate fit with the mounting apparatus 300. In operation, the mounting structure extensions 316*a*, 316*b* are slide over the inner edge of the aperture 360 onto the face plate to provide a new aperture appropriately sized.

The LEDs of this exemplary embodiment can be of any kind, color (e.g., emitting any color or white light or mixture of colors and white light as the intended lighting arrangement requires) and luminance capacity or intensity, preferably in the visible spectrum. Color selection can be made as the intended lighting arrangement requires. In accordance with the present disclosure, LEDs can comprise any semiconductor configuration and material or combination (alloy) that produce the intended array of color or colors. The LEDs can have a refractive optic built-in with the LED or placed over the LED, or no refractive optic; and can alternatively, or also, have a surrounding reflector, e.g., that re-directs low-angle and mid-angle LED light outwardly. In one suitable embodiment, the LEDs are white LEDs each comprising a gallium nitride (GaN)-based light emitting semiconductor device coupled to a coating containing one or more phosphors. The GaN-based semiconductor device can emit light in the blue and/or ultraviolet range, and excites the phosphor coating to produce longer wavelength light. The combined light output can approximate a white light output. For example, a GaN-based semiconductor device generating blue light can be combined with a yellow phosphor to produce white light. Alternatively, a GaN-based semiconductor device generating ultraviolet light can be combined with red, green, and blue phosphors in a ratio and arrangement that produces white light (or another desired color). In yet another suitable embodiment, colored LEDs are used, such are phosphide-based semiconductor devices emitting red or green light, in which case the LED assembly produces light of the corresponding color. In still yet another suitable embodiment, the LED light board may include red, green, and blue LEDs distributed on the printed circuit board in a selected pattern to produce light of a selected color using a red-green-blue (RGB) color composition arrangement. In this latter exemplary embodiment, the LED light board can be configured to emit a selectable color by selective operation of the red, green, and blue LEDs at selected optical intensities. Clusters of different kinds and colors of LED is also contemplated to obtain the benefits of blending their output.

While certain embodiments have been described herein, it will be understood by one skilled in the art that the methods, systems, and apparatus of the present disclosure may be embodied in other specific forms without departing from the spirit thereof. For example, while aspects and embodiments herein have been described in the context of certain applications, the present disclosure is not limited to such.

Accordingly, the embodiments described herein, and as claimed in the attached claims, are to be considered in all respects as illustrative of the present disclosure and not restrictive.

What is claimed is:

1. A luminaire comprising:

a housing defining a front side and a rear side;

a circuit board mounted to the housing front side;

a column extending from the housing rear side to an end;

a box mounted to the end of the column and having a stem extending downward to a lower distal end and accommodating the column within the stem; and the stem defining a groove in the lower distal end for receiving a gasket to create a seal when mounted against a structure when the luminaire is installed in the structure.

2. The luminaire of claim 1, wherein the box is a driver box housing a driver to power the circuit board.

3. The luminaire of claim 1, the structure is a canopy.

4. The luminaire of claim 1, the box being integral with the stem.

5. The luminaire of claim 1, the box for being mounted to the column.

6. A luminaire comprising:

a housing;

a column extending from the housing;

a box for housing a driver, a stem extending from the box to a distal end, the stem comprising a wall having an inner surface defining an opening configured to accommodate the column within the stem, the distal end defining a groove configured to receive a gasket to create a seal when mounted against a structure.

7. The luminaire of claim 6, wherein the box houses a driver for powering the luminaire.

8. The luminaire of claim 6, the structure is a canopy.

9. The luminaire of claim 6, the box being integral with the stem.

10. The luminaire of claim 6 wherein the wall is cylindrical.

11. The luminaire of claim 6 further comprising a gasket configured to rest in the groove.

12. The luminaire of claim 6 a utilities aperture to accommodate passage of wiring from the stem to the box.

13. A luminaire in combination with a structure, the luminaire comprising:

a housing;

a column extending from the housing;

a box for housing a driver, a stem extending from the box to a distal end, the stem comprising a wall having an inner surface defining an opening configured to accommodate the column within the stem, the distal end defining a groove;

a gasket in the groove, the gasket in contact with the structure and configured to form a seal against the structure.

14. The combination of claim 13, wherein the box is a driver box housing a driver to power the luminaire.

15. The combination of claim 13, the structure is a canopy.

16. The combination of claim 13, the box being integral with the stem.

17. The combination of claim 13, the box for being mounted to the column.

18. The combination of claim 13 wherein the wall is cylindrical.

19. The combination of claim 13, a utilities aperture to accommodate passage of wiring from the stem to the box.

20. The combination of claim 13, the structure defining a structure aperture through which the column extends and the gasket forms a seal around the structure aperture.

* * * * *